US010036561B2

(12) United States Patent
Liu et al.

(10) Patent No.: US 10,036,561 B2
(45) Date of Patent: Jul. 31, 2018

(54) INDOOR UNIT FOR AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Xing Liu, Foshan (CN); Xiaofeng Bai, Foshan (CN); Xinzhou Zhang, Foshan (CN); Dacheng Li, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 15/323,405

(22) PCT Filed: Mar. 31, 2015

(86) PCT No.: PCT/CN2015/075633
§ 371 (c)(1),
(2) Date: Dec. 31, 2016

(87) PCT Pub. No.: WO2016/154953
PCT Pub. Date: Oct. 6, 2016

(65) Prior Publication Data

US 2017/0268789 A1 Sep. 21, 2017

(51) Int. Cl.

| | |
|---|---|
| ***F28F 9/00*** | (2006.01) |
| ***F24F 1/00*** | (2011.01) |
| ***F24F 13/20*** | (2006.01) |

(52) U.S. Cl.
CPC ..... *F24F 1/0059* (2013.01); *F24F 1/0025* (2013.01); *F24F 13/20* (2013.01); *F24F 2001/0048* (2013.01)

(58) Field of Classification Search
CPC ..... F24F 1/0059; F24F 1/0025; F24F 13/20; F24F 2001/0048; B64F 1/34
(Continued)

(56) References Cited

U.S. PATENT DOCUMENTS 2,710,717 A * 6/1955 Palmer ..... F04D 29/646 261/30
5,575,326 A 11/1996 Asami et al.
(Continued)

FOREIGN PATENT DOCUMENTS

CN 102374630 3/2012
CN 102472508 A 5/2012
(Continued)

OTHER PUBLICATIONS

ISA/CN, International Search Report for PCT/CN2015/075633.
APO, Office Action for AU Application No. 2015388526, dated Dec. 14, 2017.

*Primary Examiner* — Davis Hwu
(74) *Attorney, Agent, or Firm* — Hodgson Russ LLP

(57) ABSTRACT

An indoor unit of an air conditioner includes a housing, a fan and a heat exchanger. The housing includes an upper base plate provided with an air inlet, a lower base plate detachably mounted to the upper base plate, and a front cover detachably mounted to the upper base plate; the fan is detachably mounted to the lower base plate; and the heat exchanger is detachably mounted to the upper base plate, in which the heat exchanger includes a supporting seat and a heat exchanger core body mounted to the supporting seat. The upper base plate is provided with a first positioning portion; the supporting seat is provided with a second positioning portion; and the first positioning portion cooperates with the second positioning portion to position the heat exchanger core body on the upper base plate.

36 Claims, 33 Drawing Sheets

(58) Field of Classification Search
USPC ..... 165/67
See application file for complete search history.

(56) References Cited

U.S. PATENT DOCUMENTS

| | | | | |
|---|---|---|---|---|
| 6,206,085 | B1 | 3/2001 | Correa | |
| 2009/0112368 | A1* | 4/2009 | Mann, III | B64F 1/34 700/275 |
| 2011/0314855 | A1 | 12/2011 | Yu et al. | |

FOREIGN PATENT DOCUMENTS

| | | | |
|---|---|---|---|
| CN | 203478574 | U | 3/2014 |
| CN | 103994562 | | 8/2014 |
| CN | 204043172 | U | 12/2014 |
| CN | 104422026 | A | 3/2015 |
| JP | 2004020151 | A | 1/2004 |
| JP | 2004190991 | A | 7/2004 |
| JP | 2006214670 | A | 8/2006 |
| WO | 2010107209 | | 9/2010 |

* cited by examiner

P–P

Q–Q

INDOOR UNIT FOR AIR CONDITIONER

RELATED APPLICATIONS

This U.S. application claims priority under 35 U.S.C. 371 to, and is a U.S. National Phase application of, the International Patent Application No. PCT/CN2015/075633, filed on Mar. 31, 2015. The entire contents of the before-mentioned patent applications are incorporated by reference as part of the disclosure of this U.S. application.

FIELD

The present invention relates to a field of household appliances, and more particularly to an indoor unit for an air conditioner.

BACKGROUND

An indoor unit in the prior art has a housing that is constituted by a base plate, a face frame mounted to the base plate, and a panel mounted to the face frame. A heat exchanger and a fan are mounted to the base plate, and a fan wheel of the fan is located at an inner side of the heat exchanger. The heat exchanger needs to be dismounted for after-sales repair of a motor and the fan wheel, which is complicated to operate.

SUMMARY

The present invention aims to solve at least one of the problems existing in the related art. Thus, embodiments of the present invention provide an indoor unit for an air conditioner. It is convenient to assemble or disassemble a fan and a heat exchanger of the indoor unit.

According to the embodiments of the present invention, the indoor unit includes: a housing that includes an upper base plate provided with an air inlet, a lower base plate detachably mounted to the upper base plate and provided with an air outlet, and a front cover detachably mounted to the upper base plate; a fan detachably mounted to the lower base plate; and a heat exchanger detachably mounted to the upper base plate and having a supporting seat and a heat exchanger core body mounted to the supporting seat. The upper base plate is provided with a first positioning portion, the supporting seat is provided with a second positioning portion, and the first positioning portion is configured to be fitted with the second positioning portion to position the heat exchanger core body to the upper base plate.

In the indoor unit according to the embodiments of the present invention, convenient dismounting of the fan and the heat exchanger facilitates cleaning thereof, and the cleaning of the fan wheel does not need the heat exchanger to be dismounted or mounted, which avoids the problem that the heat exchanger tends to break down due to the dismounting and mounting thereof during the cleaning of the fan, thus facilitating the maintenance of the indoor unit and reducing the failure rate of the indoor unit.

In some embodiments, the first positioning portion is configured as a hanging groove, and the second positioning portion is configured as a hanging element.

Specifically, the hanging element protrudes beyond an outer edge of the supporting seat and obliquely extends upwards along a direction from front to rear; the hanging element has a supporting plane at a bottom thereof, and the supporting plane is supported on a bottom wall of the hanging groove.

Advantageously, an upper portion of the hanging element has an inclined surface, a top portion of the hanging groove is provided with a fitting surface, and the inclined surface and the fitting surface abut against each other to position the hanging element in the hanging groove.

Further, the supporting seat is further provided with a positioning protrusion; the upper base plate is provided with a positioning groove, and the positioning protrusion is fitted in the positioning groove.

In some embodiments, a plurality of bent pipe structures are provided at an end of the heat exchanger core body, one end of the heat exchanger core body is mounted to the supporting seat, the supporting seat is provided with a plurality of mounting holes corresponding to the plurality of bent pipe structures, at least one of the plurality of mounting holes is a positioning mounting hole, an elastic cantilever is provided in the positioning mounting hole, and is configured to avoid the bent pipe structure when the heat exchanger core body is mounted and configured to be restored to position a corresponding bent pipe structure after the heat exchanger core body is mounted in place.

In some specific embodiments, part of a side wall of the positioning mounting hole is configured as the elastic cantilever, and a free end of the elastic cantilever is provided with a protrusion protruding towards a center of the positioning mounting hole.

Alternatively, a gap is formed between the free end of the elastic cantilever and rest of the side wall of the positioning mounting hole.

Preferably, the protrusion is provided with a guiding inclined surface.

In some specific embodiments, the heat exchanger is detachably provided to the upper base plate, the upper base plate is provided with the first positioning portion and the supporting seat is provided with the second positioning portion, and the second positioning portion is fitted with the first positioning portion to position the heat exchanger core body to the upper base plate.

In some embodiments, the upper base plate includes: a rear baffle, to which the heat exchanger is mounted; an upper cover plate having a rear edge connected with an upper edge of the rear baffle and provided with the air inlet; a left end plate having a rear edge connected with a left edge of the rear baffle and an upper edge connected with a left edge of the upper cover plate; and a right end plate having a rear edge connected with a right edge of the rear baffle and an upper edge connected with a right edge of the upper cover plate. The lower base plate is detachably mounted at a right side of the left end plate and at a left side of the right end plate, the left end plate is located at a left side of the lower base plate and the right end plate is located at a right side thereof.

Specifically, the upper base plate further includes: a left shield plate mounted to a left side of the left end plate; and a right shield plate mounted to a right side of the right end plate, in which the front cover is detachably mounted over the left shield plate and the right shield plate.

Advantageously, an air inlet grille is provided at the air inlet of the upper cover plate.

Preferably, the air inlet grille is integrally formed in the upper cover plate.

In some specific embodiments, the front cover is pivotably mounted to the upper base plate.

Specifically, the front cover defines a covering chamber, the upper base plate and the lower base plate are disposed in the covering chamber and covered by the front cover, and an air supply port corresponding to the air outlet is provided in the front cover.

In some specific embodiments, the front cover includes: a front panel covering front surfaces of the upper base plate and the lower base plate; a lower panel having a front edge connected with a lower edge of the front panel, and covering a lower surface of the lower base plate, in which the air supply port is provided at a position where the front panel and the lower panel are connected; a left panel having a front edge connected with a left edge of the front panel and a lower edge connected with a left edge of the lower panel, and rotatably mounted to a left side of the upper base plate and covering the left side thereof; and a right panel having a front edge connected with a right edge of the front panel and a lower edge connected with a right edge of the lower panel, and rotatably mounted at a right side of the upper base plate and covering the right side thereof.

Preferably, the front panel is connected with the lower panel via an arc transition portion.

In some embodiments, the fan includes: a fan wheel detachably mounted to the lower base plate; and a motor detachably mounted to the lower base plate and connected with the fan wheel in a transmission way.

Specifically, a motor mounting groove is provided in the lower base plate, the upper base plate is provided with a water receiving cover, the motor is mounted in the motor mounting groove, the water receiving cover is located below the heat exchanger and presses the motor in the motor mounting groove.

Specifically, an air deflector is provided at the air outlet of the lower base plate and exposed from the air supply port.

In some embodiments, the lower base plate and the upper base plate define a piping-running through hole; and the indoor unit further includes a pipe-running cover plate detachably mounted to the upper base plate and the lower base plate and covering the piping-running through hole.

Specifically, the pipe-running cover plate includes: a vertical plate detachably mounted to the upper base plate; and a horizontal plate connected with the vertical plate and detachably mounted to the lower base plate.

Specifically, a side snap hook is provided at an upper edge of the vertical plate and extends outwards, a side snap groove is provided in a side wall of the upper base plate, and the side snap hook is snap-fitted in the side snap groove.

Alternatively, a side-snap-hook guiding surface is provided at an end face of the side snap hook away from the vertical plate.

Alternatively, a rear snap hook is provided at the upper edge of the vertical plate and extends rearwards, a rear snap groove is provided in a rear wall of the upper base plate, and the rear snap hook is snap-fitted in the rear snap groove.

Alternatively, a rear-snap-hook guiding surface is provided at an end face of the rear snap hook away from the vertical plate.

Alternatively, an upper arc positioning groove is provided in an inner surface of the upper edge of the vertical plate, the upper base plate is provided with an upper arc positioning rib, and the upper arc positioning rib is fitted in the upper arc positioning groove.

Alternatively, a lower snap hook is provided at a side edge of the horizontal plate away from the vertical plate and extends downwards, a lower snap groove is provided in a bottom wall of the lower base plate, and the lower snap hook is snap-fitted in the lower snap groove.

Further, a guiding groove is provided at a side edge of the bottom wall of the lower base plate facing towards the horizontal plate, the lower snap hook is slidably fitted in the guiding groove, and a part of the bottom wall of the lower base plate is clamped between the lower snap hook and the horizontal plate.

Alternatively, a lower-snap-hook guiding surface is provided at an end face of the lower snap hook away from the horizontal plate, and a snap-hook guiding surface is provided in an inner wall of the guiding groove facing towards the horizontal plate and configured to be fitted with the lower-snap-hook guiding surface.

Preferably, a stopping rib is provided at an outer bottom surface of the lower base plate, and the side edge of the horizontal plate away from the vertical plate abuts against the stopping rib.

Alternatively, a horizontal-plate guiding surface is provided at the side edge of the horizontal plate remote from the vertical plate, and a lower-base-plate guiding surface is provided at the side edge of the bottom wall of the lower base plate facing towards the horizontal plate and configured to be fitted with the horizontal-plate guiding surface.

In some embodiments, two piping-running through holes are provided at the left side and the right side of the upper base plate, and two pipe-running cover plates are provided to cover the piping-running through holes respectively.

Specifically, the supporting seat is provided at a left end of the heat exchanger core body and configured as a left supporting seat, a right connecting plate is provided at a right end of the heat exchanger core body, the left supporting seat is provided with a left hanging element, a left hanging groove is provided in the upper base plate, and the left hanging element is fitted in the left hanging groove to hang the left supporting seat to the upper base plate. The indoor unit further includes a water receiving cover disposed to the right connecting plate and provided with a right hanging element, a right hanging groove is provided in the upper base plate, and the right hanging element is fitted in the right hanging groove to hang the water receiving cover to the upper base plate.

Alternatively, the left hanging element protrudes beyond an outer edge of the left supporting seat and obliquely extends upwards along a direction from front to rear, and the right hanging element protrudes beyond an outer edge of the water receiving cover and obliquely extends upwards along the direction from front to rear.

Alternatively, a bottom of the left hanging element has a left supporting plane and the left supporting plane is supported on a bottom wall of the left hanging groove, and a bottom of the right hanging element has a right supporting plane and the right supporting plane is supported on a bottom wall of the right hanging groove.

Alternatively, an upper portion of the left hanging element has a left inclined surface, a top portion of the left hanging groove is provided with a left fitting surface, and the left inclined surface and the left fitting surface abut against each other to position the left hanging element in the left hanging groove; and an upper portion of the right hanging element has a right inclined surface, a top portion of the right hanging groove is provided with a right fitting surface, and the right inclined surface and the right fitting surface abut against each other to position the right hanging element in the right hanging groove.

Alternatively, a front end of the left fitting surface has a left guiding surface, and an included angle between the left guiding surface and a vertical direction is larger than an included angle between the left fitting surface and the vertical direction; and a front end of the right fitting surface has a right guiding surface, and an included angle between the right guiding surface and the vertical direction is larger than an included angle between the right fitting surface and the vertical direction.

Alternatively, an upper end of a rear wall of the left supporting seat is higher than a lower end of the left hanging element, such that a top wall of the left hanging groove abuts against the rear wall of the left supporting seat; and an upper end of a rear wall of the water receiving cover is higher than a lower end of the right hanging element, such that a top wall of the right hanging groove abuts against the rear wall of the water receiving cover.

Alternatively, two right hanging elements are provided and spaced apart from each other in a left and right direction.

In some embodiments, a retaining protrusion is provided on the water receiving cover, a retaining hole is provided in the right connecting plate, and the retaining protrusion is configured to be fitted with the retaining hole to position the water receiving cover to the right connecting plate.

Further, the water receiving cover is further fastened to the right connecting plate via a screw.

In some embodiments, the heat exchanger is provided with an input-output pipe; and the indoor unit further includes a pipe-routing press strip mounted to an inner surface of the housing and pressing the input-output pipe against the inner surface of the housing.

In some embodiments, an inserting column and a snap hook are provided at two ends of the pipe-routing press strip respectively, the housing is provided with an inserting groove and a snap step, the inserting column is inserted in the inserting groove while the snap hook is hung to the snap step.

In some embodiments, a snap strip and a mounting plate are provided at two ends of the pipe-routing press strip respectively, the housing is provided with a clamping portion, the snap strip is connected with the clamping portion in a clamping manner; and the mounting plate is mounted to the housing via a first threaded fastener.

In some embodiments, a pipe-through groove is provided in the inner surface of the housing, and the pipe-routing press strip presses the input-output pipe in the pipe-through groove.

In some embodiments, the pipe-routing press strip is provided with a window running through the pipe-routing press strip along a thickness direction of the pipe-routing press strip, and a part of the input-output pipe pressed by the pipe-routing press strip is exposed out of the pipe-routing press strip via the window.

In some embodiments, the indoor unit further includes a water receiving cover mounted in the housing and located between the heat exchanger and the fan.

In some embodiments, a sliding groove is provided in the housing, the water receiving cover is provided with a sliding rail, and the sliding rail is slidably hung in the sliding groove.

In some embodiments, a pipe-through port is provided in the water receiving cover, and the input-output pipe passes through the pipe-through port.

In some embodiments, a water-receiving-cover position limiting protrusion is provided on the water receiving cover, and the heat exchanger is stopped by the water-receiving-cover position limiting protrusion.

In some embodiments, the indoor unit further includes an electric control box assembly. The electric control box assembly includes an electric control box body; an electric control box lid provided at a top of the electric control box body; an electric control printed circuit board provided in the electric control box body and arranged along a vertical direction; a ground sheet provided at the top of the electric control box body; and a wire holder provided at the top of the electric control box body and located on the ground sheet.

In some embodiments, a mounting groove is formed in each of two opposite inner walls of the electric control box body, and each end of the electric control printed circuit board extends into a corresponding mounting groove.

In some embodiments, an extension part is provided at the top of the electric control box body and extends in a direction running away from a center of the electric control box body, in which the ground sheet and the wire holder are provided on the extension part.

In some embodiments, the extension part is provided with a first position limiting rib, and the first position limiting rib includes two first position limiting sub-ribs that are spaced apart from each other in a width direction of the ground sheet.

In some embodiments, the extension part is provided with a second position limiting rib spaced apart from the first position limiting rib in a length direction of the ground sheet, and the second position limiting rib includes two second position limiting sub-ribs that are spaced apart from each other in the width direction of the ground sheet. The wire holder is disposed between the first position limiting rib and the second position limiting rib.

In some embodiments, the ground sheet is provided with at least one ground screw, and the extension part is provided with at least one seal sleeve fitted with the at least one ground screw.

In some embodiments, a plurality of ground screws are provided and spaced apart from one another along the length direction of the ground sheet.

In some embodiments, a snap piece is provided at at least one of two ends of the ground sheet along the length direction thereof, and the extension part is provided with a snap groove fitted with the snap piece.

In some embodiments, the snap piece is formed by bending a part of the ground sheet.

In some embodiments, the ground sheet is connected to the extension part via a second threaded fastener.

In some embodiments, the electric control box body is provided with a plurality of wire-running hooks.

In some embodiments, at least one fastener is provided at a bottom of the electric control box body.

In some embodiments, the electric control box lid is connected to the top of the electric control box body via a snap.

In some embodiments, the indoor unit further includes a guide assembly for guiding the lower base plate when mounting and dismounting the lower base plate. The guide assembly includes: a guide groove provided in the upper base plate, and a guide rail fitted with the guide groove and disposed on the lower base plate.

In some embodiments, the guide groove is provided with a position limiting protrusion, the guide rail is provided with a position limiting groove, and the position limiting protrusion is fitted in the position limiting groove.

In some embodiments, the upper base plate is provided with a connecting groove, the lower base plate is provided with a connecting protrusion, and the connecting protrusion is fitted in the connecting groove.

In some embodiments, the lower base plate is further mounted to the upper base plate via a third threaded fastener.

Additional aspects and advantages of embodiments of present invention will be given in part in the following descriptions, become apparent in part from the following descriptions, or be learned from the practice of the embodiments of the present invention.

BRIEF DESCRIPTION OF THE DRAWINGS

These and other aspects and advantages of embodiments of the present disclosure will become apparent and more readily appreciated from the following descriptions made with reference to the drawings, in which.

Figure 1:
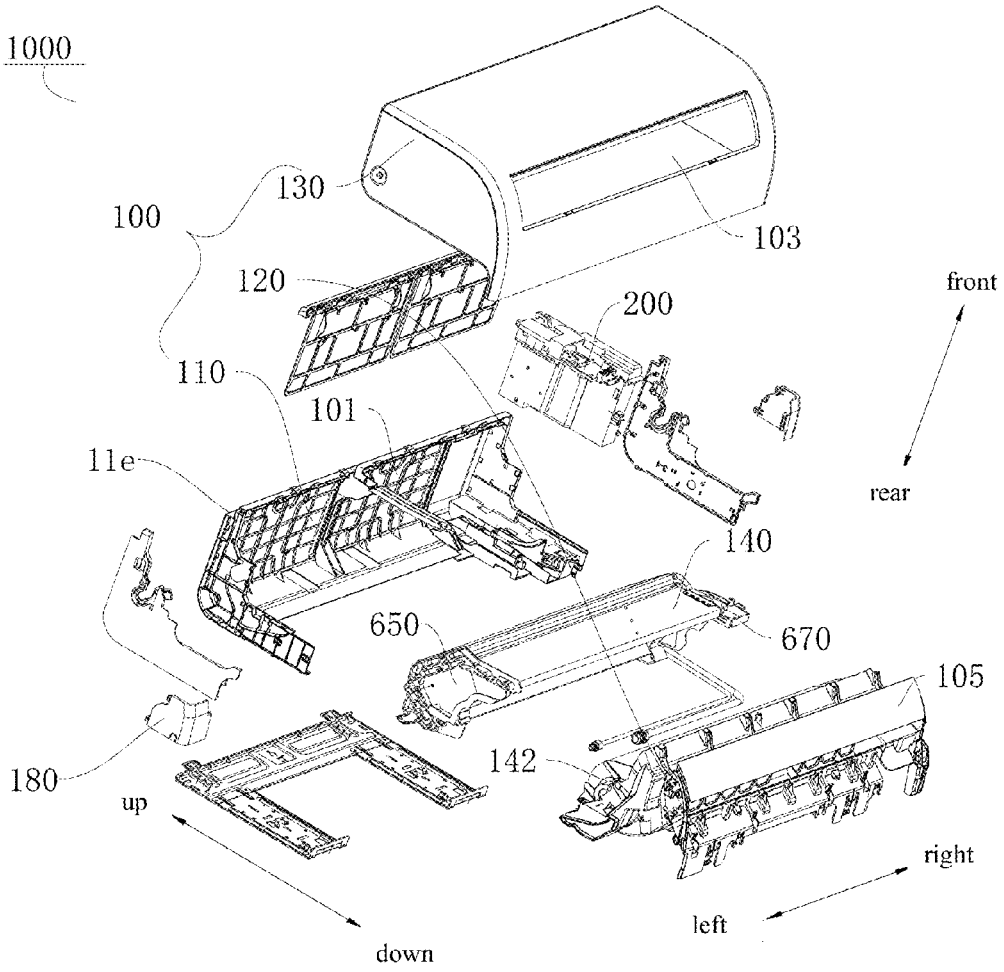
FIG. 1 is an exploded schematic view of an indoor unit of an air conditioner in a direction according to an embodiment of the present invention.

REFERENCE NUMERALS indoor unit 1000 of air conditioner, housing 100, air inlet 101, air supply port 103, covering chamber 104, air deflector 105, upper base plate 110, rear baffle 111, upper cover plate 112, left end plate 113, right end plate 114, left shield plate 115, right shield plate 116, air inlet grille 117, side snap groove 11*f*, rear snap groove 11*m*, upper arc positioning rib 11*n*, clamping portion 191*b*, lower base plate 120, lower snap groove 122, guiding groove 123, snap-hook guiding surface 124, stopping rib 125, lower-base-plate guiding surface 126, guide assembly 14, guide groove 1401, guide rail 1402, position limiting protrusion 151, position limiting groove 152, connecting groove 153, elastic arm 155, pipe-running cover plate 180, piping-running through hole 181, vertical plate 182, side snap hook 1821, side-snap-hook guiding surface 1822, rear snap hook 1823, rear-snap-hook guiding surface 1824, upper arc positioning groove 1825, horizontal plate 183, lower snap hook 1831, lower-snap-hook guiding surface 1832, horizontal-plate guiding surface 1833, front cover 130, front panel 131, lower panel 132, left panel 133, right panel 134, heat exchanger 140, water-receiving-cover position limiting protrusion 141*a*, pipe-through port 141*b*, fan 142, fan wheel 143, motor 144, first positioning portion 510, hanging groove 511, fitting surface S1, guiding surface F, positioning groove 512, heat exchanger core body 530, bent pipe structure 531, supporting seat 540, mounting hole 541, positioning mounting hole 542, elastic cantilever 543, protrusion 544, gap 545, guiding inclined surface y, second positioning portion 550, hanging element 551, inclined surface S3, supporting plane S4, positioning protrusion 552, left hanging groove 610, bottom wall 611 of left hanging groove, top wall 612 of left hanging groove, left fitting surface 613, left guiding surface 614, inserting connection groove 620, right hanging groove 630, bottom wall 631 of the right hanging groove, right fitting surface 632, right guiding surface 633, first fitting hole 640, left supporting seat 650, left hanging element 651, left supporting plane 652, left inclined surface 653, rear wall of left supporting seat 654, inserting connection clasp 655, right connecting plate 660, retaining hole 661, water receiving cover 670, right hanging element 671, right supporting plane 672, right inclined surface 673, retaining protrusion 674, screw connection column 675, second fitting hole 676, pipe-routing press strip 190, inserting column 191, snap hook 192, window 193, inserting groove 194, pipe-through groove 195, sliding groove 196, snap step 197, input-output pipe 198, snap strip 191*a*, mounting plate 192*a*, electric control box assembly 200, electric control box body 210, mounting groove 211, extension part 212, first position limiting rib 2121, first position limiting sub-rib 2121*a*, second position limiting rib 2122, second position limiting sub-rib 2122*a*, seal sleeve 2123, snap groove 2124, wire-running hook 213, fastener 214, electric control box lid 220, snap 221, electric control printed circuit board 230, ground sheet 240, ground screw 241, snap piece 242, wire holder 250, wire 251.

DETAILED DESCRIPTION

Embodiments of the present invention will be described in detail and examples of the embodiments will be illustrated in the drawings, where same or similar reference numerals are used to indicate same or similar members or members with same or similar functions. The embodiments described herein with reference to drawings are explanatory, which are used to illustrate the present invention, but shall not be construed to limit the present invention.

In the following, an indoor unit 1000 of an air conditioner according to embodiments of the present invention will be described with reference to FIGS. 1 to 58.

It shall be noted that directional terms, such as "up and down," "left and right" and "front and rear," are determined based on orientations when the indoor unit 1000 is mounted and used normally. That is, when the indoor unit 1000 is mounted and used normally, a side facing towards a user is considered as "front", a side away from the user as "rear", a side located at the left of the user as "left", and a side located at the right of the user as "right".

Figure 2:
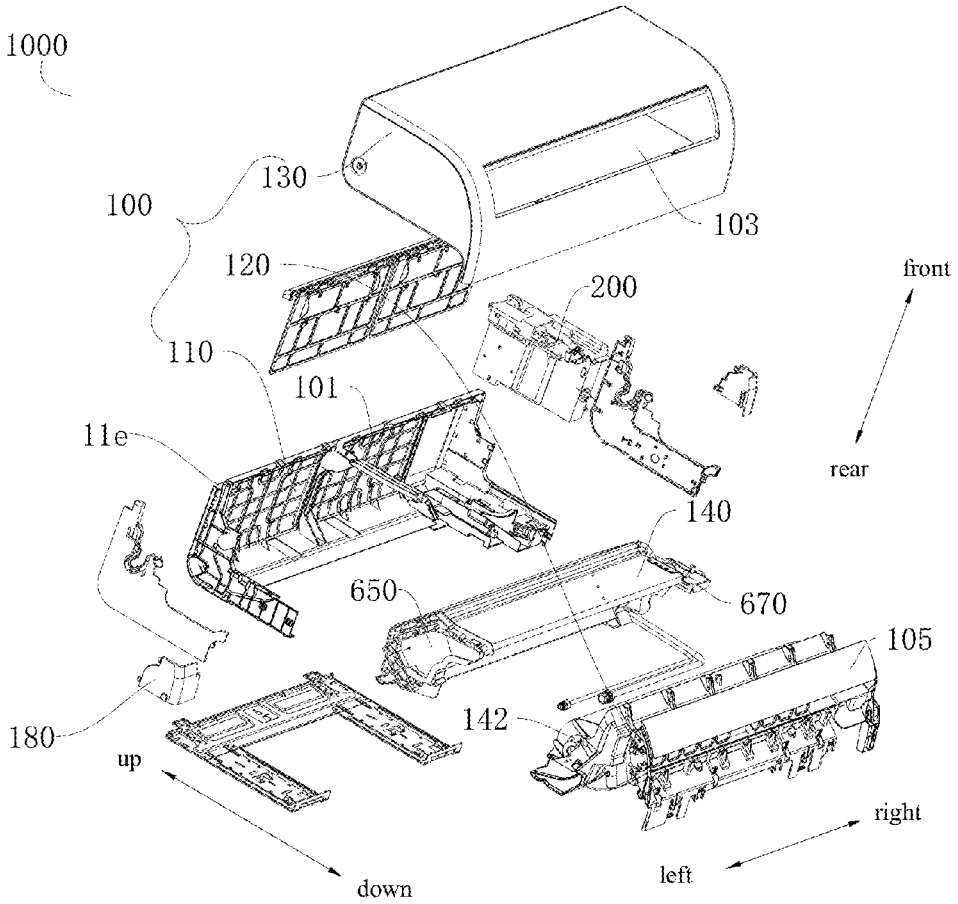
FIG. 2 is an exploded schematic view of an indoor unit of an air conditioner in another direction according to an embodiment of the present invention.

As shown in FIGS. 1 and 2, the indoor unit 1000 according to embodiments of the present invention includes a housing 100, a heat exchanger 140 and a fan 142.

Specifically, the housing 100 includes an upper base plate 110, a lower base plate 120 detachably mounted to the upper base plate 110, and a front cover 130 detachably mounted to the upper base plate 110. The upper base plate 110 is provided with an air inlet 101 for air supply, and the lower base plate 120 is provided with an air outlet (not shown) for air exhaust. Driven by the fan 142, an air flow enters the indoor unit 1000 from the air inlet 101 and is sent out through the air outlet. The air flow exchanges heat with the heat exchanger 140 in the indoor unit 1000. The heat exchanger 140 is mounted to the upper base plate 110 and the fan 142 is detachably mounted to the lower base plate 120.

The fan 142 is mounted to the lower base plate 120 and the lower base plate 120 is detachably mounted to the upper base plate 110, such that when the fan 142 needs to be cleaned, maintained and repaired, the lower base plate 120 just needs to disassembled from the upper base plate 110, and thus the fan 142 can be disassembled from the indoor unit 1000, which avoids the problem in the prior art that the heat exchanger 140 affects the assembling and dissembling of the fan 142. Moreover, the cleaning of a fan wheel 143 does not involve the dismounting and mounting of the heat exchanger 140, which avoids the problem that the heat exchanger 140 tends to break down due to the dismounting and mounting thereof during the cleaning of the fan 142, thus facilitating the maintenance of the indoor unit 1000 and reducing the failure rate of the indoor unit 1000. The heat exchanger 140 is detachably mounted to the upper base plate 110, which facilitates the dismounting of the heat exchanger 140 and thus the cleaning and maintenance thereof.

With the indoor unit 1000 according to embodiments of the present invention, the convenient dismounting of the fan 142 and the heat exchanger 140 facilitates the cleaning thereof, and the cleaning of the fan wheel 143 does not involve the dismounting and mounting of the heat exchanger 140, which thus avoids the problem that the heat exchanger 140 tends to break down due to the dismounting and mounting thereof during the cleaning of the fan 142, thereby facilitating the maintenance of the indoor unit 1000 and reducing the failure rate of the indoor unit 1000.

Figure 12:
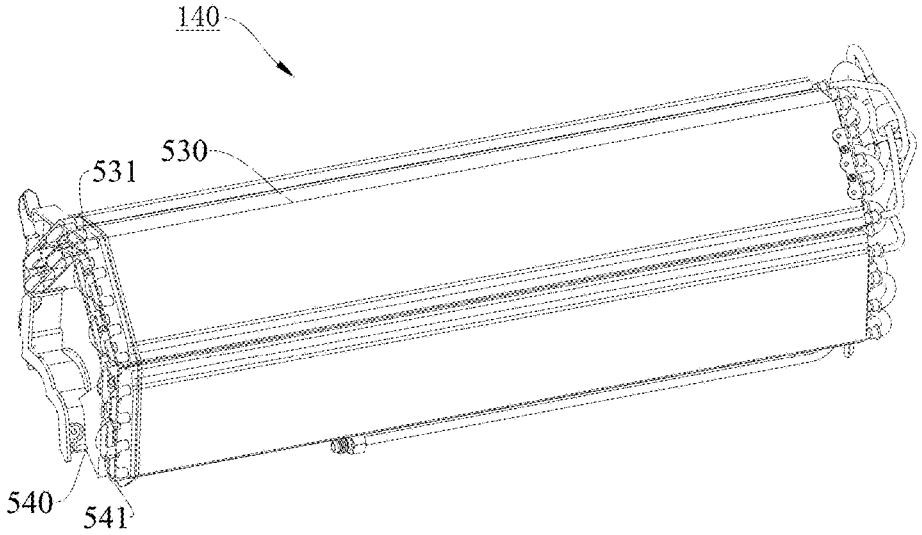
FIG. 12 is a schematic view of a heat exchanger according to an embodiment of the present invention.
Figure 13:
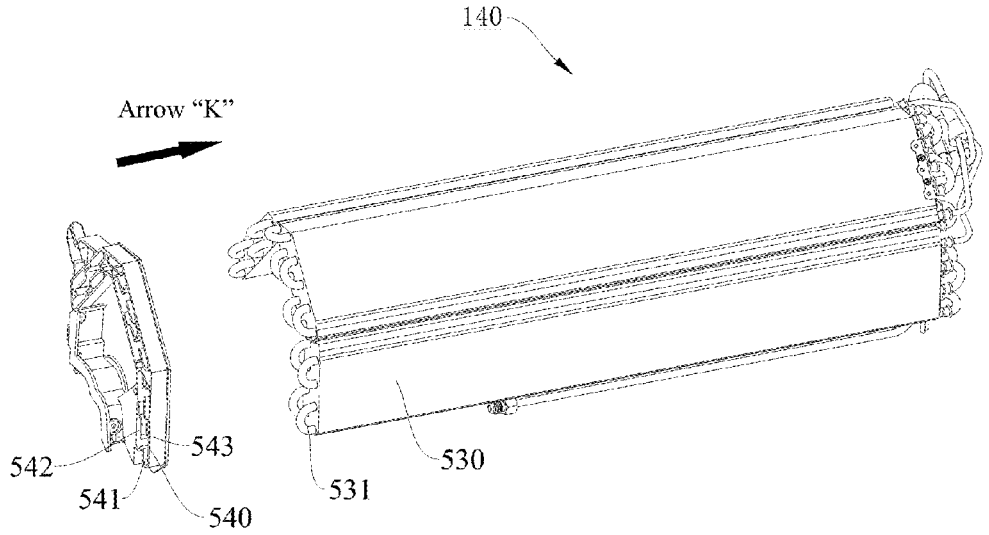
FIG. 13 is an exploded schematic view of a heat exchanger according to an embodiment of the present invention.

As shown in FIGS. 12 to 13, the heat exchanger 140 includes a heat exchanger core body 530 and a supporting seat 540. A plurality of bent pipe structures 531 are provided at ends of the heat exchanger core body 530, and one end of the heat exchanger core body 530 is mounted to the supporting seat 540.

The bent pipe structure 531 of the heat exchanger core body 530 is used to circulate refrigerant for heat exchange. The supporting seat 540 is configured to support the heat exchanger core body 530. The supporting seat 540 is mounted to the upper base plate of the indoor unit 1000 after the heat exchanger core body 530 is fixed to the supporting seat 540. That is, the heat exchanger core body 530 is mounted and fixed to the upper base plate via the supporting seat 540.

Figure 14:
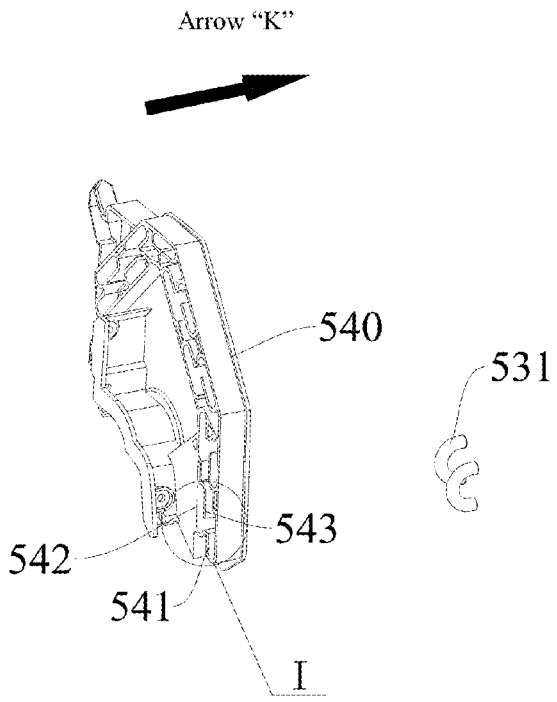
FIG. 14 is a schematic view of a supporting seat and a bent pipe structure of a heat exchanger core body according to an embodiment of the present invention.
Figure 15:
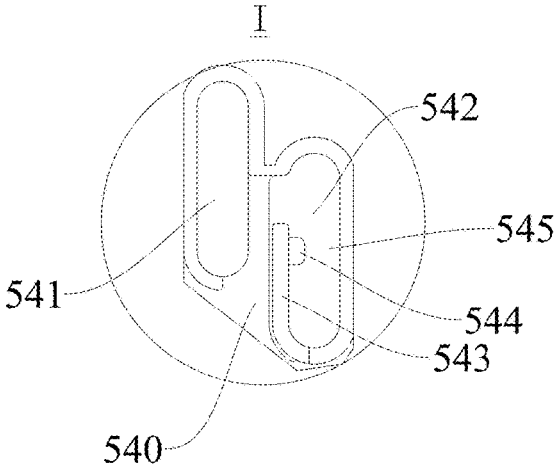
FIG. 15 is a partial schematic view of a part of the supporting seat represented by I in FIG. 14.

Referring to FIGS. 14 and 15, the supporting seat 540 is provided with a plurality of mounting holes 541 corresponding to the plurality of bent pipe structures 531. At least one of the plurality of mounting holes 541 is configured as a positioning mounting hole 542 that is provided with an elastic cantilever 543 therein. The elastic cantilever 543 is configured to avoid the bent pipe structure 531 in the process of mounting the heat exchanger core body 530 and configured to be restored to position the corresponding bent pipe structure 531 after the heat exchanger core body 531 is mounted to its place. In the process of mounting the supporting seat 540 to the heat exchanger core body 530, the supporting seat 540 is pressed onto the heat exchanger core body 530 along a direction represented by Arrow K in FIGS. 14 and 15.

In such a way, when the heat exchanger core body 530 is mounted to the supporting seat 540, the elastic cantilever 543 may avoid the bent pipe structure 531, to facilitate inserting the bent pipe structure 531 into the corresponding mounting hole 541. After the bent pipe structure 531 is inserted in place, the elastic cantilever 543 is restored to make the bent pipe structure 531 stuck, such that the bent pipe structure 531 will not be detached from the mounting hole 541 easily, which guarantees the reliability of connecting the supporting seat 540 with the heat exchanger core body 530 and facilitates the assembling of the supporting seat 540 with the heat exchanger core body 530, thereby greatly improving the assembling efficiency of the heat exchanger 140 with less time. Moreover, if the heat exchanger core body 530 needs to be dismounted from the supporting seat 540, the supporting seat 540 may be directly pulled out in a direction moving away from the heat exchanger core body 530. That is, the bent pipe structure 531 may be directly pulled out from the mounting hole 541. The heat exchanger core body 530 is easy to be disassembled.

Additionally, the mounting hole 541 is provided to protect the bent pipe structure 531. When the air conditioner is transported, the supporting seat 540 may protect the heat exchanger core body 530, especially the bent pipe structure 531, to avoid collision damage of the bent pipe structure 531. Furthermore, the elastic cantilever 543 may cushion impact on the bent pipe structure 531, due to certain elasticity of the elastic cantilever 543.

Figure 3:
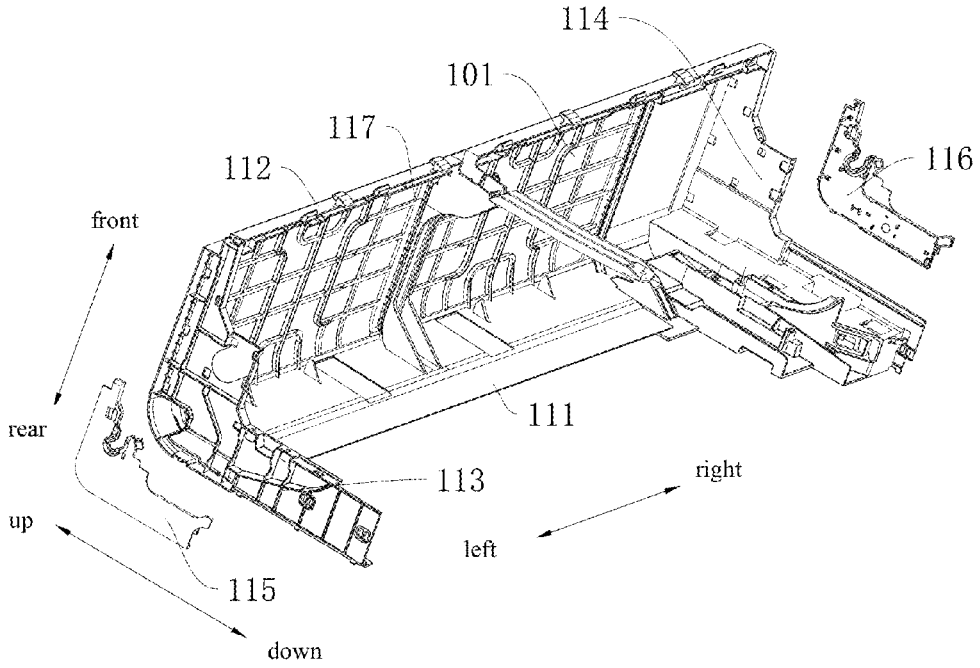
FIG. 3 is a schematic view of an upper base plate of an indoor unit of an air conditioner according to an embodiment of the present invention.

With reference to FIGS. 1 to 3, in some embodiments of the present invention, the upper base plate 110 includes: a rear baffle 111, an upper cover plate 112, a left end plate 113 and a right end plate 114. The heat exchanger 140 is mounted to the rear baffle 111, a rear edge of the upper cover plate 112 is connected with an upper edge of the rear baffle 111, and the air inlet 101 is formed in the upper cover plate 112, such that it is convenient for the air flow to enter the indoor unit 1000 from the air inlet 101 to exchange heat. The left end plate 113 has a rear edge connected with a left edge of the rear baffle 111 and an upper edge connected with a left edge of the upper cover plate 112. The right end plate 114 has a rear edge connected with a right edge of the rear baffle 111 and an upper edge connected with a right edge of the upper cover plate 112, so as to enhance the structural strength of the upper base plate 110 and facilitate mounting the heat exchanger 140 to the upper base plate 110, thereby improving the whole structural strength of the indoor unit 1000.

Additionally, by providing the air inlet 101 in the upper cover plate 112 of the upper base plate 110 and mounting the heat exchanger 140 to the rear baffle 111, a gap may be effectively formed between the heat exchanger 140 and the upper cover plate 112 provided with the air inlet 101, such that the air flow may enter the indoor unit 1000 smoothly, and the smooth circulation of the air flow is guaranteed, thus improving the working efficiency of the indoor unit 1000 of the air conditioner.

Preferably, the lower base plate 120 is detachably mounted at the right side of the left end plate 113 and at the left side of the right end plate 114. The left end plate 113 is located at a left side of the lower base plate 120, and the right end plate 114 is located at a right side of the lower base plate 120, so that it is convenient to mount the lower base plate 120 to the upper base plate 110 and also to disassemble the lower base plate 120 therefrom.

Further, with reference to FIGS. 1 to 3, the upper base plate 110 further includes a left shield plate 115 and a right shield plate 116. The left shield plate 115 is mounted to a left side of the left end plate 113, and the right shield plate 116 is mounted to a right side of the right end plate 114, so as to further improve the structural strength of the upper base plate 110 via the left shield plate 115 and the right shield plate 116 and to enhance the sealing performance of the left and right sides of the upper base plate 110, along with a beautiful appearance of the housing 100.

Preferably, the front cover 130 is detachably mounted over the left shield plate 115 and the right shield plate 116, which facilitates mounting the front cover 130 and improves the assembling and maintenance efficiency of the indoor unit 1000.

Advantageously, as shown in FIG. 3, an air inlet grille 117 is provided at the air inlet 101 of the upper cover plate 112, which makes it convenient for the air flow to enter the indoor unit 1000 via the air inlet 101, and prevents dust outside from entering the indoor unit 1000 to a certain extent, i.e., reduces the amount of the dust outside entering the indoor unit 1000, so as to facilitate cleaning the indoor unit 1000 and improve the stability and safety of the operation thereof.

Advantageously, the air inlet grille 117 is integrally formed in the upper cover plate 112, so as to improve the structural strength of the air inlet grille 117 and facilitate the molding of the upper cover plate 112.

Additionally, the upper base plate 110 according to the present invention may include other forms. For example, the upper base plate 110 may only include the rear baffle 111, but not include the upper cover plate 112, and the rear baffle 111 is provided with positions where the heat exchanger 140 and the lower base plate 120 are mounted.

In some embodiments of the present invention, the front cover 130 is pivotably mounted to the upper base plate 110. That is, the front cover 130 is mounted to the upper base plate 110 and rotatable between a first position where the housing 100, the heat exchanger 140 and the fan 142 are shielded and a second position where the housing 100, the heat exchanger 140 and the fan 142 are exposed, so as to facilitate mounting the heat exchanger 140 and the fan 142 to the housing 100 and dismounting the heat exchanger 140 and the fan 142 therefrom.

Figure 4:
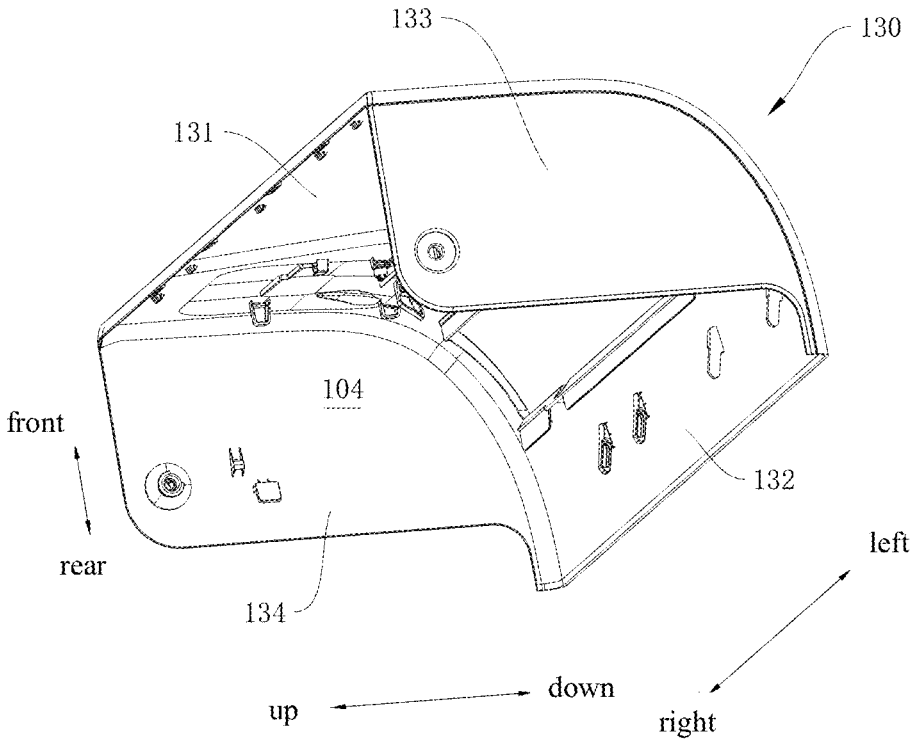
FIG. 4 is a schematic view of a front cover of an indoor unit of an air conditioner according to an embodiment of the present invention.

Referring to FIGS. 1 and 4, in some embodiments of the present invention, the front cover 130 has an covering chamber 104 therein, and the upper base plate 110 and the lower base plate 120 are disposed in the covering chamber 104 and shielded by the front cover 130, such that the indoor unit 1000 has a beautiful appearance and is enclosed, which is conductive to oriented air supply. Alternatively, an air supply port 103 corresponding to the air outlet is provided in the front cover 130 and configured to avoid the air outlet.

Further, with reference to FIGS. 1, 2 and 4, the front cover 130 includes a front panel 131, a lower panel 132, a left panel 133 and a right panel 134. The front panel 131 covers front surfaces of the upper base plate 110 and the lower base plate 120. The lower panel 132 has a front edge connected with a lower edge of the front panel 131, and covers a lower surface of the lower base plate 120, in which the air supply port 103 is provided at a position where the front panel 131 and the lower panel 132 are connected. The left panel 133 has a front edge connected with a left edge of the front panel 131 and a lower edge connected with a left edge of the lower panel 132, and is rotatably mounted to a left side of the upper base plate 110 and covers the left side thereof. The right panel 134 has a front edge connected with a right edge of the front panel 131 and a lower edge connected with a right edge of the lower panel 132, and is rotatably mounted to a right side of the upper base plate 110 and covers the right side thereof.

Further, with reference to FIGS. 1 and 4, the left panel 133 is provided at the left side of the upper base plate 110, and the right panel 134 is provided at the right side of the upper base plate 110. A rotating shaft is provided at each of a rear end of an upper portion of the left panel 133 and a rear end of an upper portion of the right panel 134, while a shaft hole fitted with the rotating shaft is provided in each of the left shield plate 115 and the right shield plate 116 of the upper base plate 110, so as to realize the rotatable mounting of the front cover 130 to the housing 100 via the shaft-hole fit.

Advantageously, the front panel 131 is connected with the lower panel 132 via an arc transition portion, to make the appearance of the indoor unit 100 aesthetic. Moreover, the indoor unit 1000 having a rounded-off surface is less easy to be damaged than the indoor unit 1000 having an angular surface during the transportation of the indoor unit 1000.

Additionally, the front panel 131 and the lower panel 132 of the front cover 130 may be molded separately, in which the lower panel 132 may be separately fixed to the lower panel 120 or integrally molded with the lower panel 120.

Figure 5:
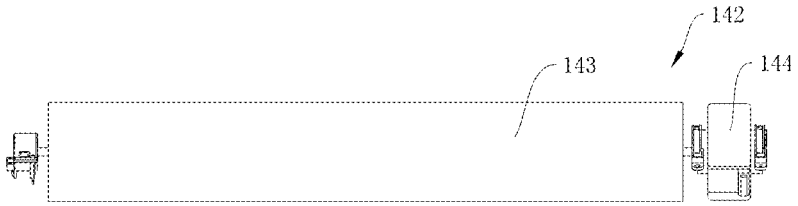
FIG. 5 is a schematic view of a fan of an indoor unit of an air conditioner according to an embodiment of the present invention.

As shown in FIG. 5, in some embodiments of the present invention, the fan 142 includes the fan wheel 143 and a motor 144. The fan wheel 143 is detachably mounted to the lower base plate 120, and the motor 144 is detachably mounted to the lower base plate 120 and connected with the fan wheel 143 in a transmission way, so as to facilitate the operation, mounting and dismounting of the fan 142.

Further, the lower base plate 120 is provided with a motor mounting groove (not shown), and the upper base plate 110 is provided with a water receiving cover 670. The motor 144 is mounted in the motor mounting groove, and the water receiving cover 670 is located below the heat exchanger 140 and presses the motor 144 in the motor mounting groove.

In some embodiments of the present invention, an air deflector 105 is provided at the air outlet of the lower base plate 120 and exposed from the air supply port 103, to guide the direction of the air flow sent out from the indoor unit 1000.

Figure 6:
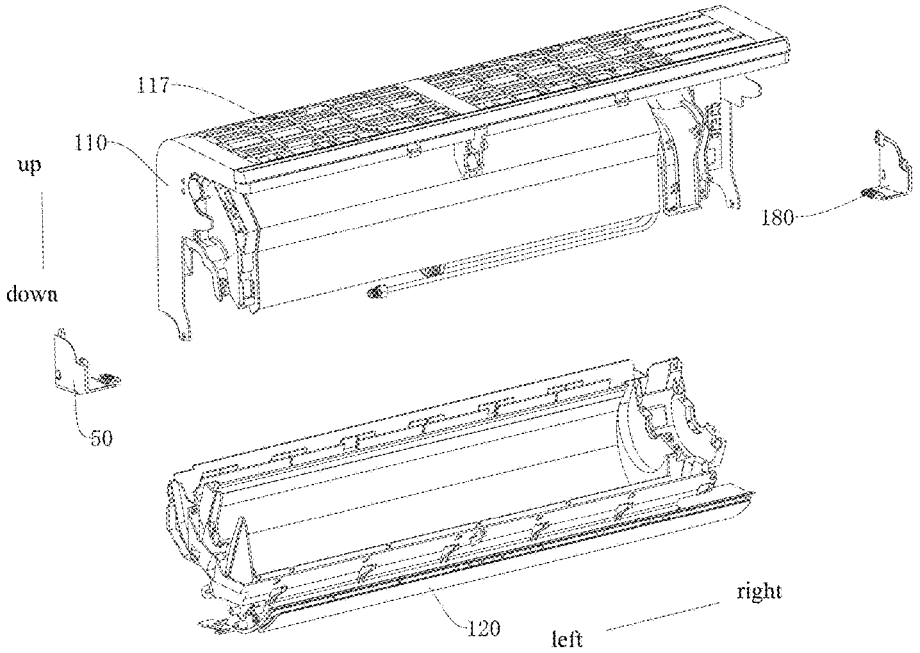
FIG. 6 is an exploded view of an upper base plate and a lower base plate of an indoor unit of an air conditioner according to an embodiment of the present invention.
Figure 7:
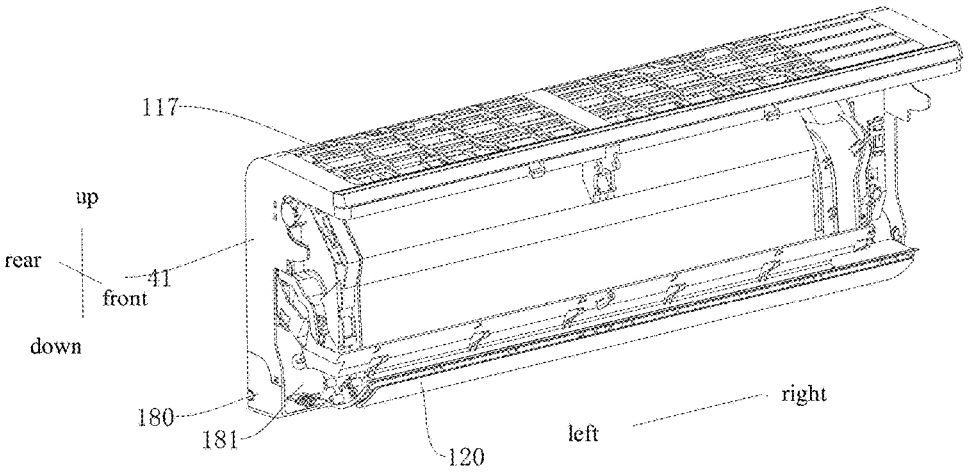
FIG. 7 is a schematic view of an upper base plate and a lower base plate of an indoor unit of an air conditioner according to an embodiment of the present invention.

With reference to FIGS. 6 and 7, the upper base plate 110 and the lower base plate 120 define a piping-running through hole 181, and a pipe-running cover plate 180 is detachably mounted to the upper base plate 110 and the lower base plate 120 and covers the piping-running through hole 181. As shown in FIG. 6, two piping-running through holes 181 are provided at the left and right sides of the base plates of the indoor unit 1000, and two pipe-running cover plates 180 are provided to cover the two piping-running through holes 181 respectively.

When the indoor unit 1000 is assembled with a pipe, the pipe-running cover plate 180 may be dismounted, such that the assembling of the indoor unit 1000 and the pipe may be completed without destroying the overall appearance of the indoor unit 1000. When the running direction of the pipe needs to be changed, the original pipe-running cover plate 180 may be mounted to the upper base plate 110 and the lower base plate 120, and the pipe-running cover plate 180 at the other side is dismounted, so as to assemble the indoor unit 1000 with the pipe. In this process, the integrity and the aesthetic appearance of the indoor unit 1000 may be guaranteed.

Figure 8:
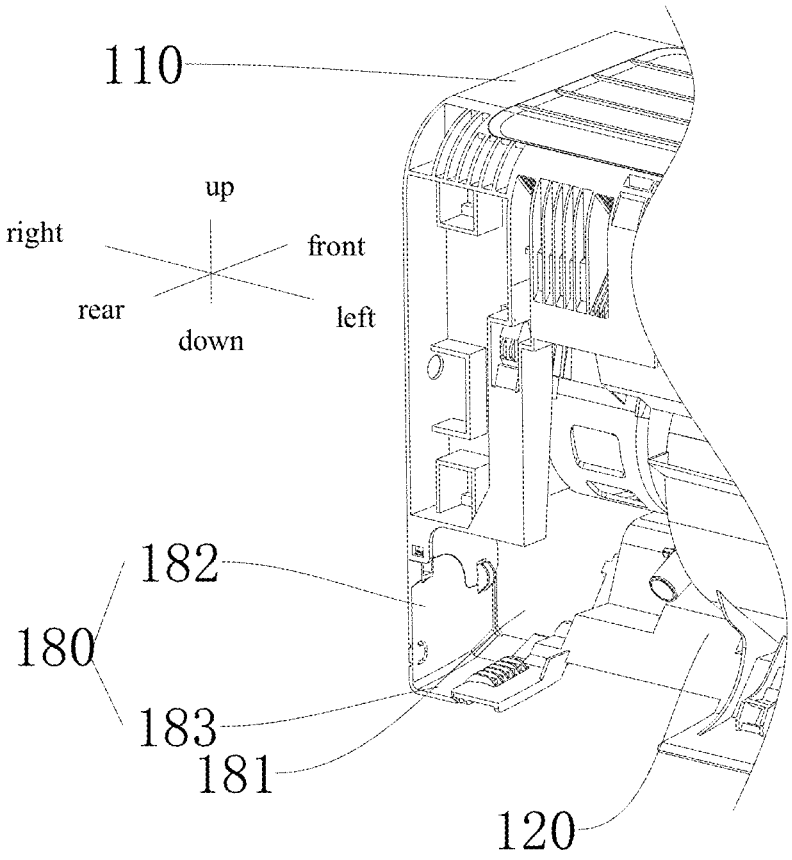
FIG. 8 is a partial schematic view of an upper base plate and a lower base plate of an indoor unit of an air conditioner according to an embodiment of the present invention.
Figure 9:
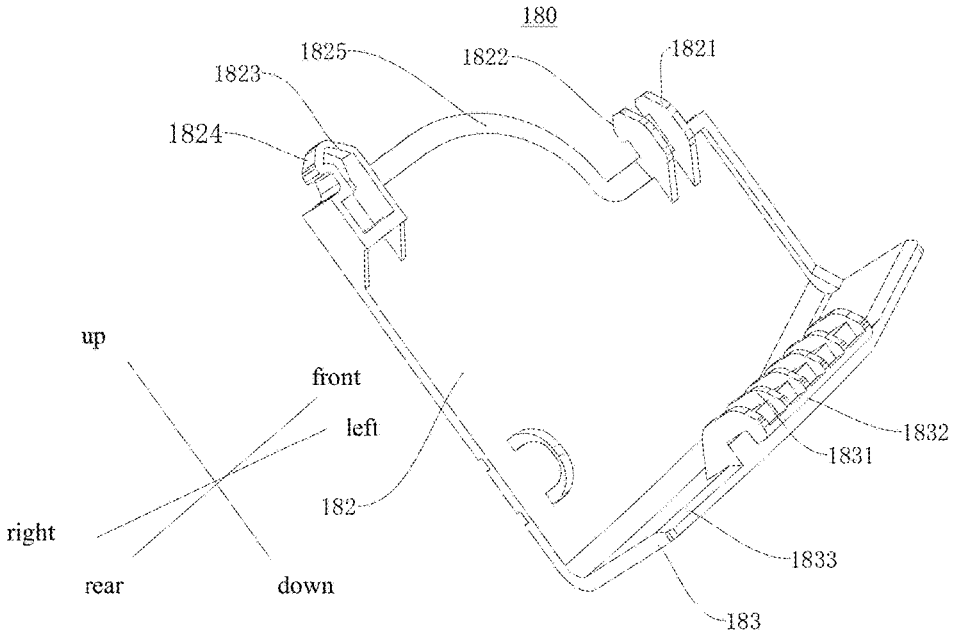
FIG. 9 is a schematic view of a pipe-running cover plate of an indoor unit of an air conditioner according to an embodiment of the present invention.

In some examples of the present invention, as shown in FIGS. 8 and 9, the pipe-running cover plate 180 may include a vertical plate 182 and a horizontal plate 183. The vertical plate 182 is detachably mounted to the upper base plate 110, and the horizontal plate 183 is connected with the vertical plate 182 and detachably mounted to the lower base plate 120.

Figure 10:
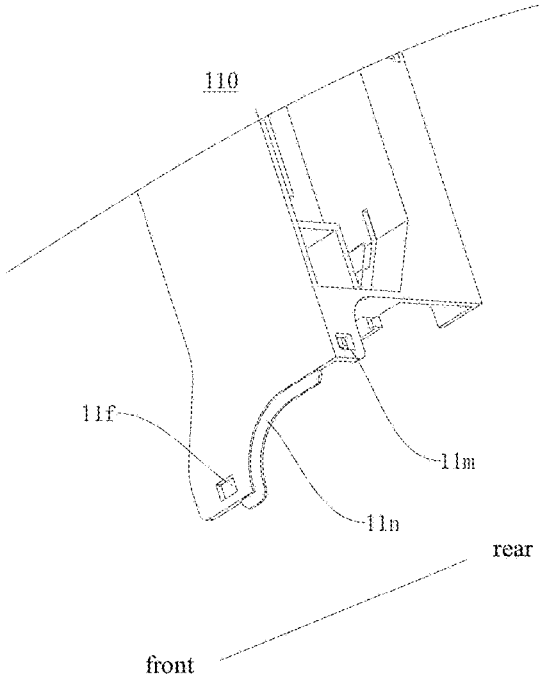
FIG. 10 is a partial schematic view of an upper base plate of an indoor unit of an air conditioner according to an embodiment of the present invention.

Alternatively, as shown in FIGS. 9 and 10, a side snap hook 1821 may be provided at an upper edge of the vertical plate 182 and extends outwards, a side snap groove **11*f* may be provided in a side wall of the upper base plate 110, and the side snap hook 1821 is snap-fitted in the side snap groove 11*f*. The expression "extending outwards" means that the side snap hook 1821 extends in a direction moving away from the upper base plate 110. The upper base plate 110 may limit a position of the vertical plate 182 in a left and right direction and in a front and rear direction by the fit of the side snap groove 11*f* and the side snap hook 1821**.

Further, a side-snap-hook guiding surface 1822 may be provided at an end face of the side snap hook 1821 away from the vertical plate 182. As shown in FIG. 9, the end face of the side snap hook 1821 away from the vertical plate 182 is an upper end face of the side snap hook 1821. The side snap hook 1821 may be snap-fitted in the side snap groove **11*f* easily by providing the side-snap-hook guiding surface 1822**.

Alternatively, as shown in FIGS. 9 and 10, a rear snap hook 1823 may be provided at the upper edge of the vertical plate 182 and extends rearwards, a rear snap groove **11*m* is provided in a rear wall of the upper base plate 110, and the rear snap hook 1823** is snap-fitted in the rear snap groove

11*m*. The upper base plate 110 may limit the position of the vertical plate 182 in the left and right direction and the front and rear direction by the fit the rear snap groove 11*m* and the rear snap hook 1823.

Further, a rear-snap-hook guiding surface 1824 may be provided at an end face of the rear snap hook 1823 away from the vertical plate 182. As shown in FIG. 9, the end face of the rear snap hook 1823 away from the vertical plate 182 is an upper end face of the rear snap hook 1823. The rear snap hook 1823 may be snap-fitted in the rear snap groove 11*m* easily by providing the rear-snap-hook guiding surface 1824.

Alternatively, as shown in FIGS. 9 and 10, an upper arc positioning groove 1825 may be provided in an inner surface of the upper edge of the vertical plate 182, the upper base plate 110 may be provided with an upper arc positioning rib 11*n*, and the upper arc positioning rib 11*n* is fitted in the upper arc positioning groove 1825. The upper base plate 110 may further limit the position of the vertical plate 182 in the left and right direction by the fit of the upper arc positioning groove 1825 and the upper arc positioning rib 11*n*.

Figure 11:
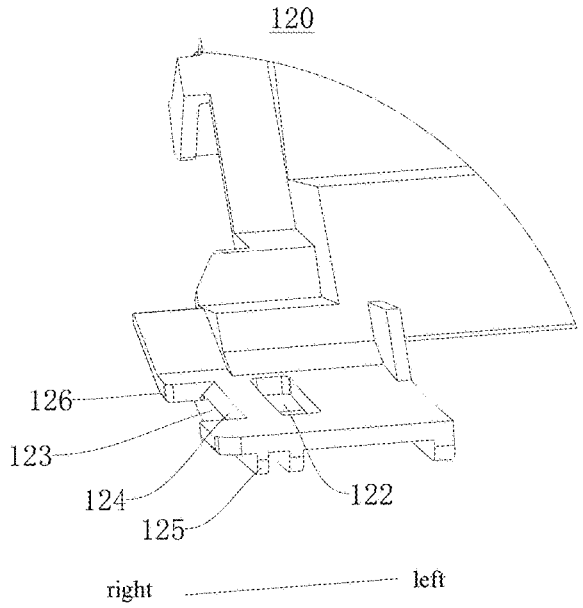
FIG. 11 is a partial schematic view of a lower base plate of an indoor unit of an air conditioner according to an embodiment of the present invention.

Alternatively, as shown in FIGS. 9 to 11, a lower snap hook 1831 may be provided at a side edge of the horizontal plate 183 away from the vertical plate 182 and extends downwards, a lower snap groove 122 may be provided in a bottom wall of the lower base plate 120, and the lower snap hook 1831 is snap-fitted in the lower snap groove 122. The pipe-running cover plate 180 shown in FIG. 9 is illustrated as an example. As shown in FIG. 9, a side edge of the horizontal plate 183 adjacent to the vertical plate 182 is a right edge of the horizontal plate 183, and a side edge of the horizontal plate 183 away from the vertical plate 182 is a left edge of the horizontal plate 183. The lower snap hook 1831 is provided at the left edge of the horizontal plate 183. The lower base plate 120 may limit the position of the horizontal plate 183 in the left and right direction and the front and rear direction by the fit of the lower snap hook 1831 and the lower snap groove 122.

Further, as shown in FIG. 11, an guiding groove 123 may be provided at a side edge of the bottom wall of the lower base plate 120 facing towards the horizontal plate 183, the lower snap hook 1831 is slidably fitted in the guiding groove 123, and a part of the bottom wall of the lower base plate 120 is clamped between the lower snap hook 1831 and the horizontal plate 183. The guiding groove 123 may play a role of pre-positioning, which makes it convenient and accurate for the lower snap hook 1831 to be fitted with the lower snap groove 122. As shown in FIG. 11, a part of the lower base plate 120 located between the guiding groove 123 and the lower snap groove 122 is clamped between the lower snap hook 1831 and the horizontal plate 183, so as to improve the fitting stability of the lower snap hook 1831 with the lower snap groove 122.

Alternatively, with reference to FIGS. 9 to 11, a lower-snap-hook guiding surface 1832 may be provided at an end face of the lower snap hook 1831 away from the horizontal plate 183, and a snap-hook guiding surface 124 may be provided at an inner wall of the guiding groove 123 facing towards the horizontal plate 183 and configured to fit with the lower-snap-hook guiding surface 1832. The lower snap hook 1831 may be snap-fitted in the lower snap groove 122 easily due to the fit of the lower-snap-hook guiding surface 1832 and the snap-hook guiding surface 124.

Specifically, a stopping rib 125 may be provided at an outer bottom surface of the lower base plate 120, and the side edge of the horizontal plate 183 away from the vertical plate 182 abuts against the stopping rib 125. With reference to FIGS. 9 to 11, the left edge of the horizontal plate 183 abuts against the stopping rib 125 to further stabilize the fitting of the horizontal plate 183 and the lower base plate 120.

Preferably, a horizontal-plate guiding surface 1833 may be provided at the side edge of the horizontal plate 183 away from the vertical plate 182, and a lower-base-plate guiding surface 126 is provided at the side edge of the bottom wall of the lower base plate 120 facing towards the horizontal plate 183 and configured to fit with the horizontal-plate guiding surface 1833. With reference to FIGS. 9 to 11, since the horizontal-plate guiding surface 1833 is fitted with the lower-base-plate guiding surface 126, the left edge of the horizontal plate 183 may be downwards snap-fitted with the bottom wall of the lower base plate 120, and abut against the stopping rib 125.

In some embodiments, the elastic cantilever 543 of the supporting seat 540 may have various kinds of configurations. For example, the elastic cantilever 543 extends inwards from an inner wall of the positioning mounting hole 542. When the bent pipe structure 531 is assembled into the positioning mounting hole 542, the elastic cantilever 543 presses against the bent pipe structure 531 due to its pre-deformation.

Figure 16:
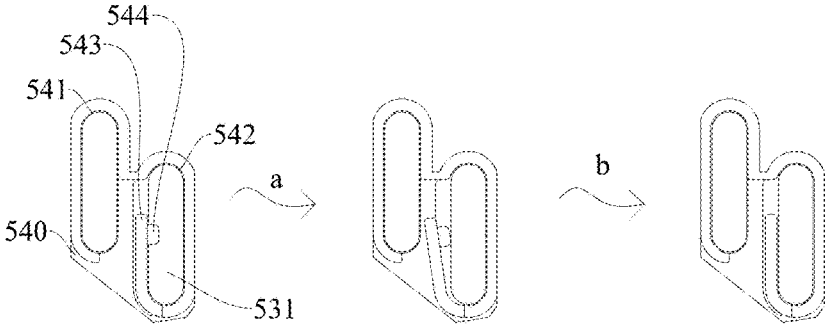
FIG. 16 is a schematic view of a process of mounting a bent pipe structure of a heat exchanger core body to a supporting seat according to an embodiment of the present invention.

In some embodiments of the present invention, with reference to FIGS. 12 to 15, part of a side wall of the positioning mounting hole 542 is configured as the elastic cantilever 543, and a free end of the elastic cantilever 543 is further provided with a protrusion 544 protruding towards a center of the positioning mounting hole 542. In this way, as shown in FIGS. 16 and 17, after the bent pipe structure 531 is inserted into the positioning mounting hole 542, the protrusion 544 is snapped into an area surrounded by a bent portion of the bent pipe structure 531, such that the bent pipe structure 531 will not be detached from the positioning mounting hole 542 easily, thus further improving the reliability of connecting the heat exchanger core body 530 with the supporting seat 540.

Herein, a size of the positioning mounting hole 542 is substantially equal to that of the bent pipe structure 531. Since the part of the side wall of the positioning mounting hole 542 is configured as the elastic cantilever 543, the bent pipe structure 531 will not shake after being inserted into the positioning mounting hole 542.

Specifically, as shown in FIG. 15, a gap 545 is formed between the free end of the elastic cantilever 543 and rest of the side wall of the positioning mounting hole 542, such that the elastic cantilever 543 may have a less deformation compared with the elastic cantilever 543 without the protrusion 544 due to the protrusion 544, in the process of inserting the bent pipe structure 531, which reduces the resistance in the process of inserting the bent pipe structure 531 into the positioning mounting hole 542 and thus makes it easier to insert the bent pipe structure 531 into the positioning mounting hole 542.

Figure 17:
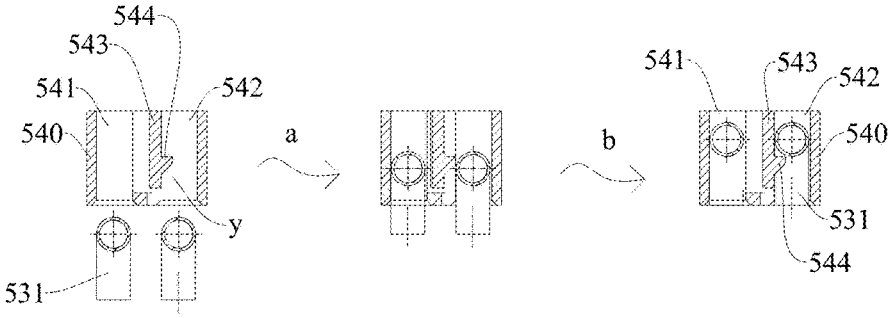
FIG. 17 is a sectional schematic view of a process of mounting a bent pipe structure of a heat exchanger core body to a supporting seat according to another embodiment of the present invention.

In some examples, as shown in FIG. 17, the protrusion 544 is provided with a guiding inclined surface y, such that the bent pipe structure 531 abuts against the guiding inclined surface y to make the elastic cantilever 543 deformed under a force applied by the bent pipe structure 531 when the bent pipe structure 531 is being inserted into the positioning mounting hole 542. By providing the guiding inclined surface y, the bent pipe structure 531 may exert the force on the elastic cantilever 543 slowly, so as to facilitate the deformation of the elastic cantilever 543.

Advantageously, as shown in FIG. 17, after the bent pipe structure 531 is fully mounted into the mounting hole 541, a free end of the bent pipe structure 531 is also located in the mounting hole 541, so as to protect the bent pipe structure 531.

In the following, the process of assembling the supporting seat 540 and the heat exchanger core body 530 will be illustrated with reference to FIGS. 16 and 17.

In an example of FIG. 16, a free end of the protrusion 544 is configured as a round head. In an example of FIG. 17, the protrusion 544 is provided with the guiding inclined surface y. The protrusion 544 configured as the round head and the guiding inclined surface y each are intended to make it convenient for the bent pipe structure 531 to press against the elastic cantilever 543, so as to deform the elastic cantilever 543.

As shown in FIGS. 16 and 17, when the bent pipe structure 531 is being inserted into the positioning mounting hole 542, the bent pipe structure 531 abuts against the protrusion 544, and the protrusion 544 is pressed and thus exerts a force that pushes the elastic cantilever 543 away from the center of the corresponding positioning mounting hole 542, such that the elastic cantilever 543 is deformed under the force and drives the protrusion 544 to run away the center of the corresponding positioning mounting hole 542, in which the corresponding process is represented by Arrow a in FIGS. 16 and 17. After the bent pipe structure 531 is fully inserted, the protrusion 544 is not subjected to the force, and the elastic cantilever 543 is restored and drives the protrusion 544 to its original position, so that the protrusion 544 extends into the positioning mounting hole 542 to make the bent pipe structure 531 stuck, in which the corresponding process is represented by Arrow b in FIGS. 16 and 17.

In some embodiments, the heat exchanger 140 is detachably mounted to the upper base plate 110. Specifically, as shown in FIGS. 18 and 19, the upper base plate is provided with a first positioning portion 510, the supporting seat 540 is provided with a second positioning portion 550, and the first positioning portion 510 is fitted with the second positioning portion 550 to position the heat exchanger core body 530 to the upper base plate, so as to facilitate the positioning and mounting of the supporting seat 540.

Figure 19:
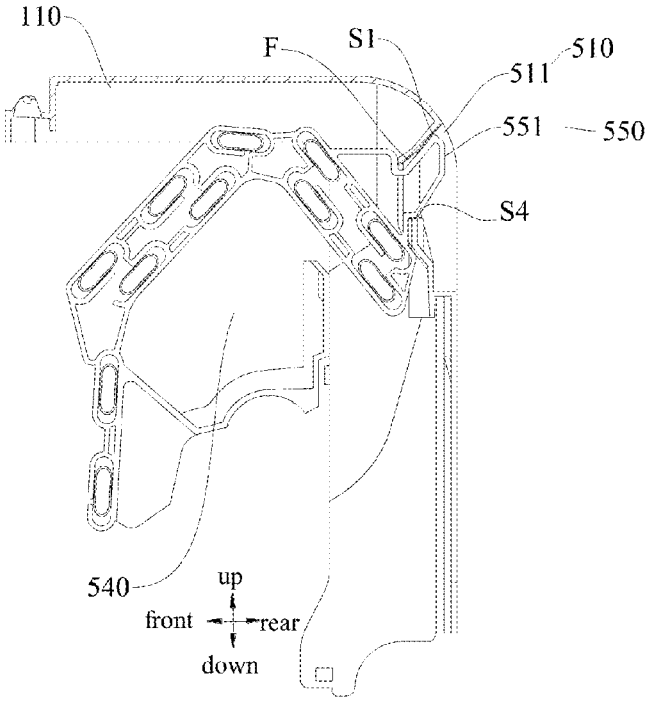
FIG. 19 is a schematic view showing a connected structure of base plates and a supporting seat according to an embodiment of the present invention.
Figure 20:
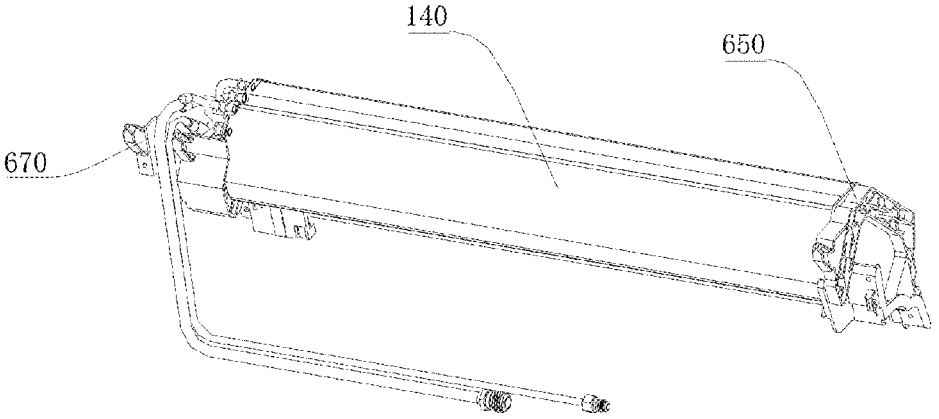
FIGS. 20 and 21 are assembly views of a heat exchanger, a left supporting seat, a right connecting plate and a right water receiving cover according to an embodiment of the present invention.
Figure 21:
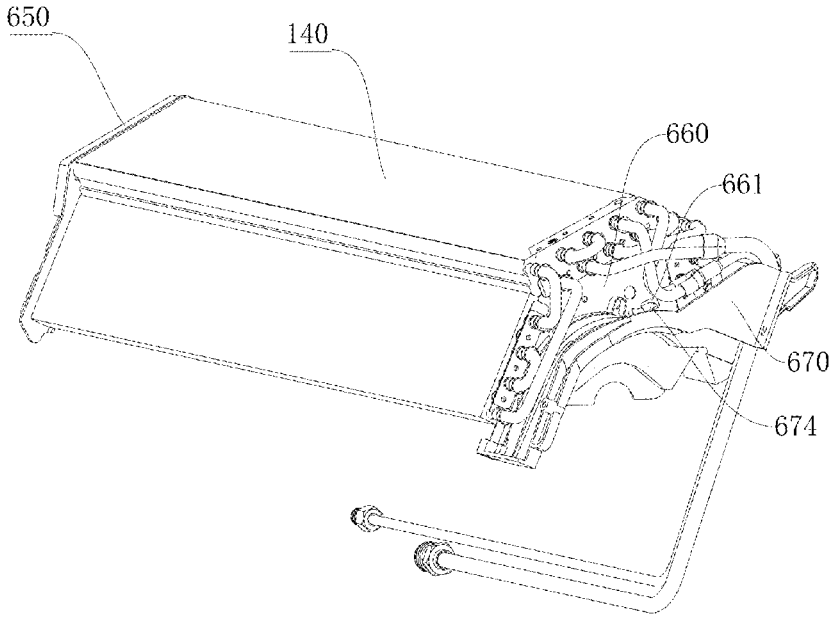
Figure 22:
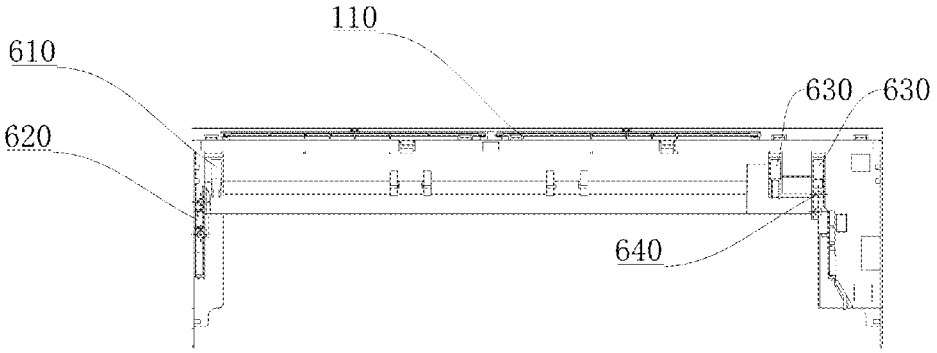
FIG. 22 is a perspective view of an upper base plate according to an embodiment of the present invention.
Figure 23:
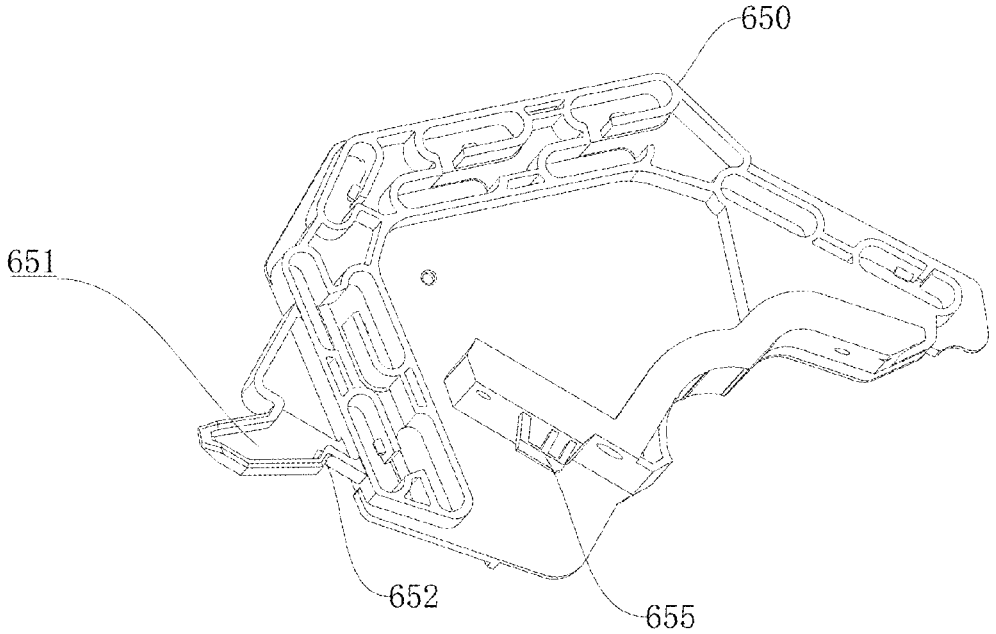
FIG. 23 is a front view of an upper base plate according to an embodiment of the present invention.
Figure 24:
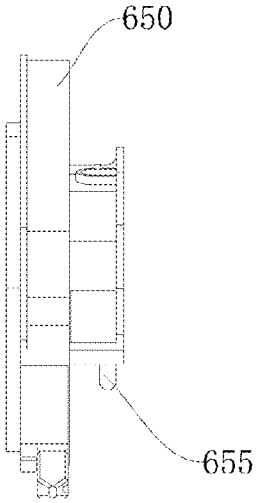
FIG. 24 is a perspective view of a water receiving cover according to an embodiment of the present invention.
Figure 25:
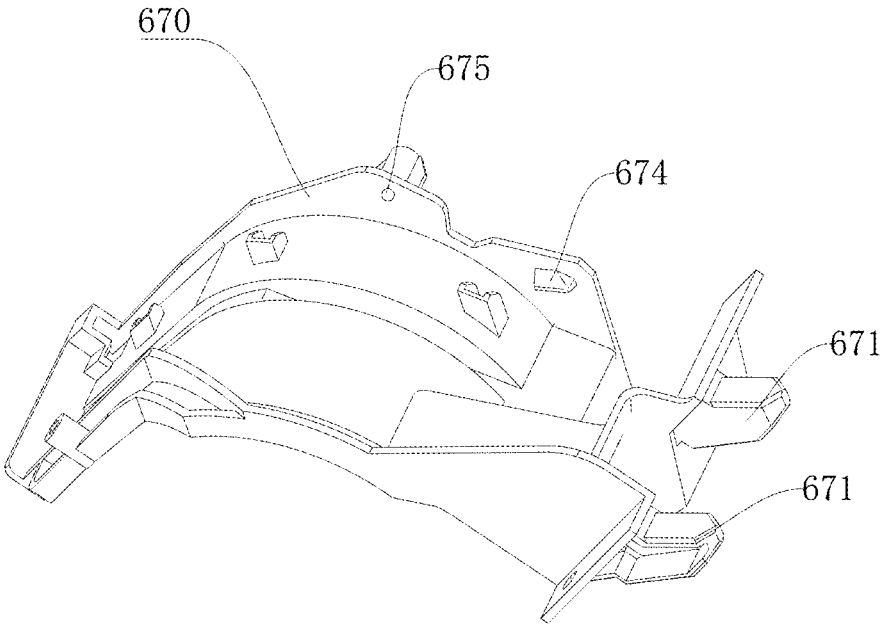
FIGS. 25 to 27 are three views of a water receiving cover according to an embodiment of the present invention.
Figure 26:
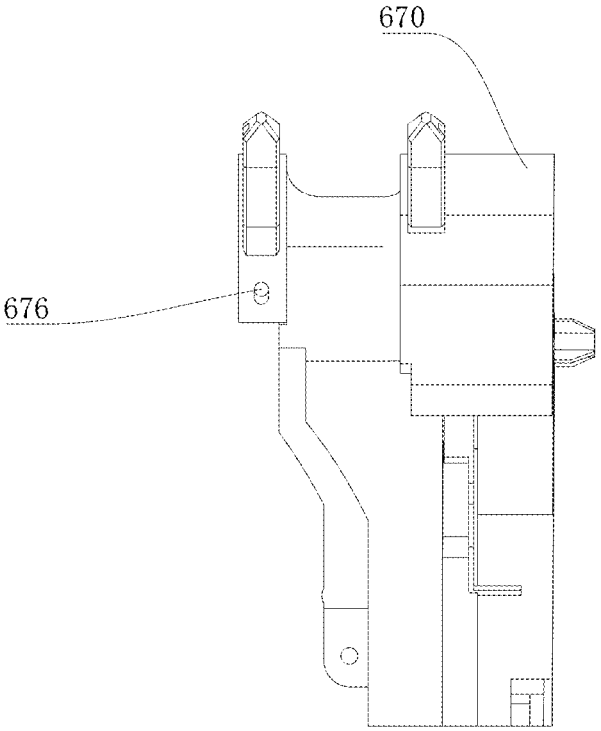
Figure 27:
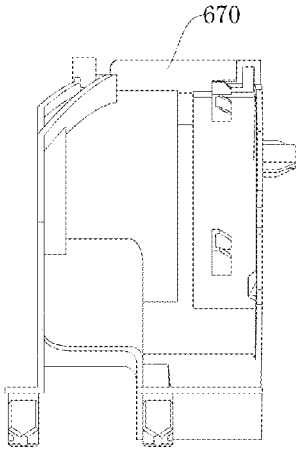
Figure 28:
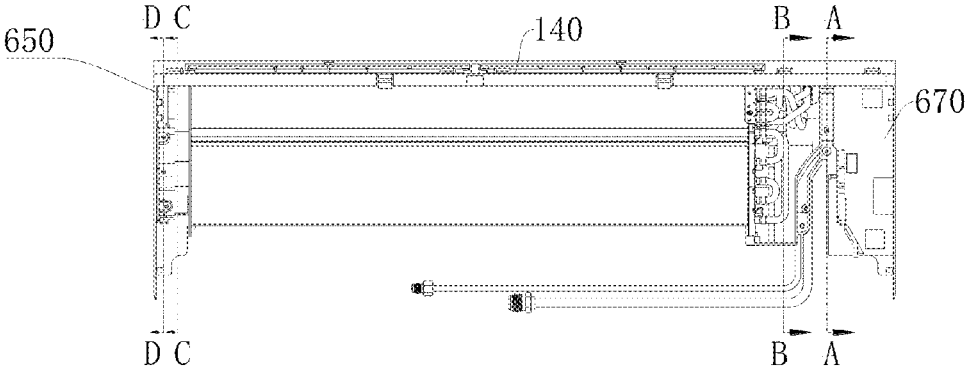
FIG. 28 is a schematic view showing an assembling process of a part of an indoor unit of an air conditioner according to an embodiment of the present invention.
Figure 29:
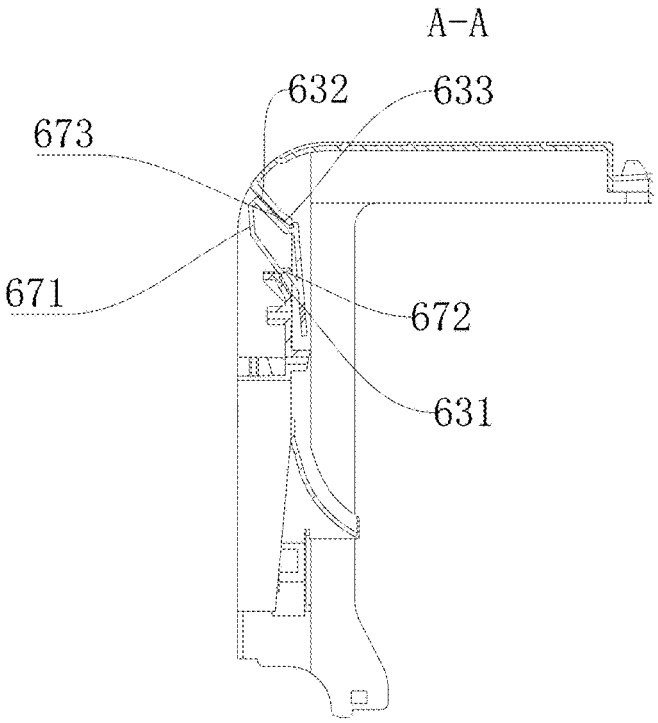
FIG. 29 is a sectional view along line A-A in FIG. 28.
Figure 30:
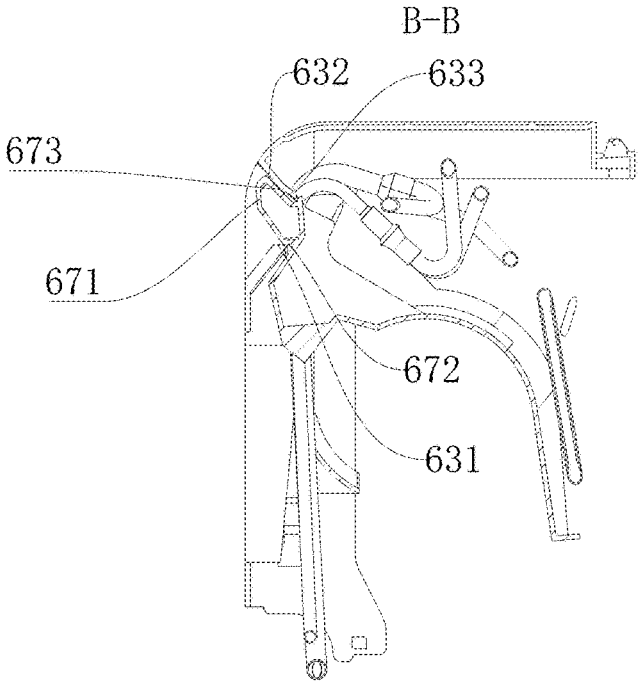
FIG. 30 is a sectional view along line B-B in FIG. 28.
Figure 31:
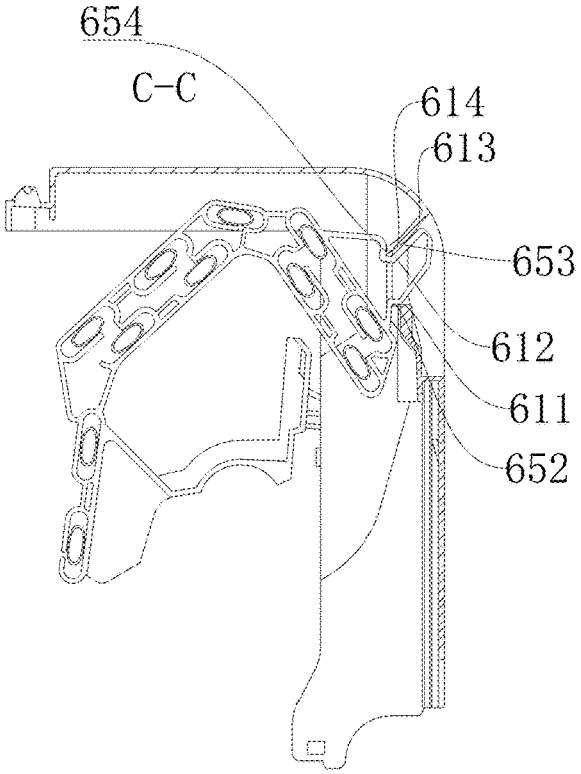
FIG. 31 is a sectional view along line C-C in FIG. 28.
Figure 32:
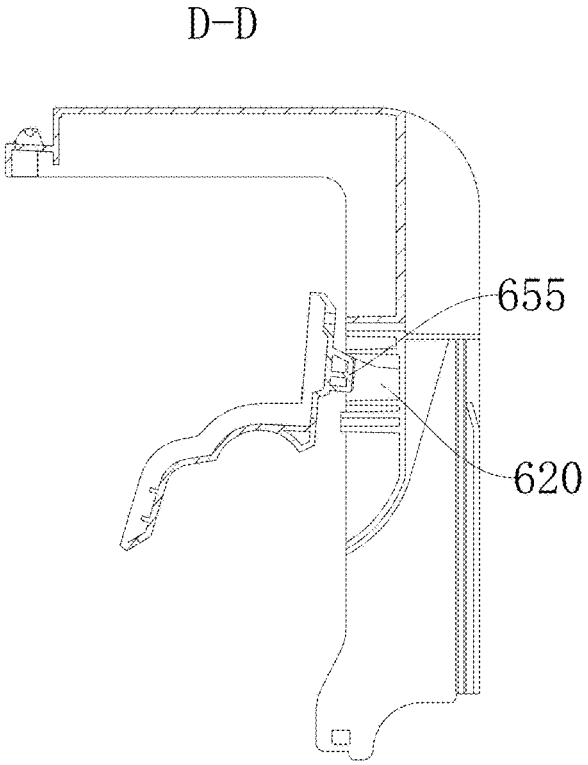
FIG. 32 is a sectional view along line D-D in FIG. 28.
Figure 33:
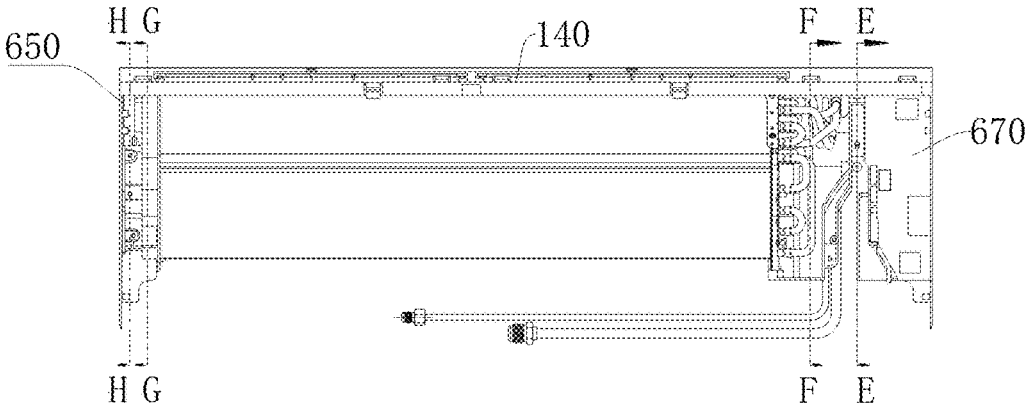
FIG. 33 is a schematic view showing an in-place assembly of the part of the indoor unit of FIG. 28.
Figure 34:
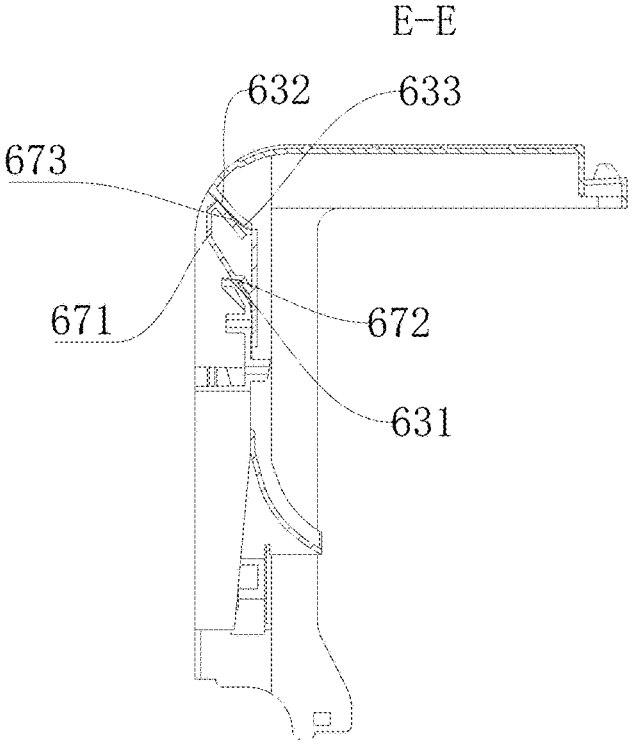
FIG. 34 is a sectional view along line E-E in FIG. 33.
Figure 35:
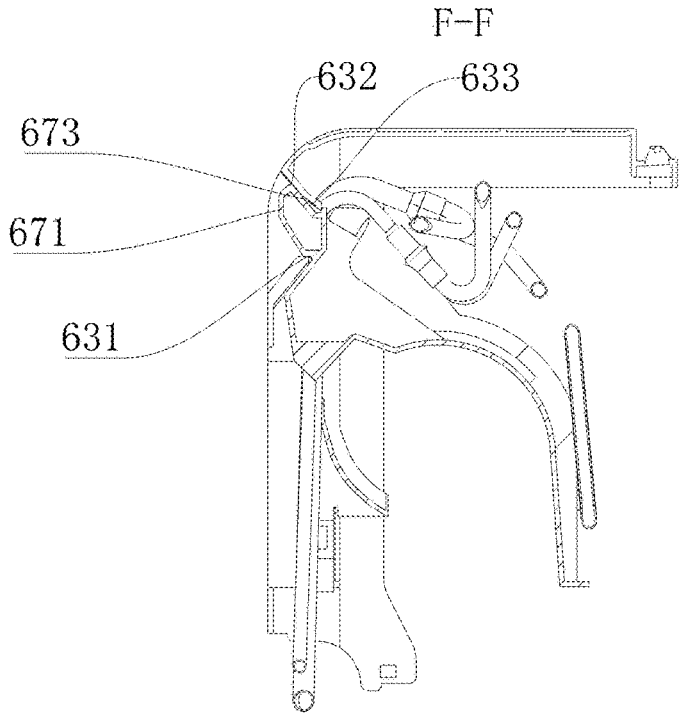
FIG. 35 is a sectional view along line F-F in FIG. 33.
Figure 36:
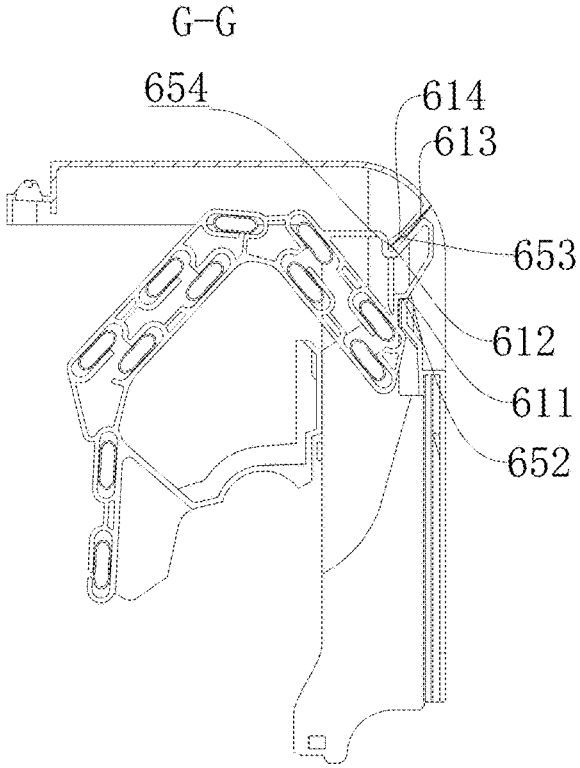
FIG. 36 is a sectional view along line G-G in FIG. 33.
Figure 37:
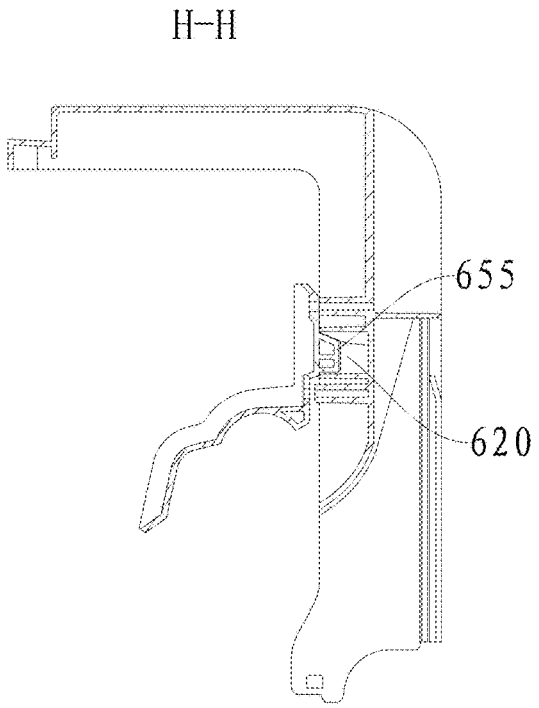
FIG. 37 is a sectional view along line H-H in FIG. 33.

In some embodiments, as shown in FIG. 19, the first positioning portion 510 is configured as a hanging groove 511, and the second positioning portion 550 is configured as a hanging element 551, such that the first positioning portion 510 and the second positioning portion 550 have simple structures and are easy to be assembled.

Certainly, the structures of the first positioning portion 510 and the second positioning portion 550 may be not limited to this. The first positioning portion 510 and the second positioning portion 550 may employ other positioning structures disclosed in the prior art.

Figure 18:
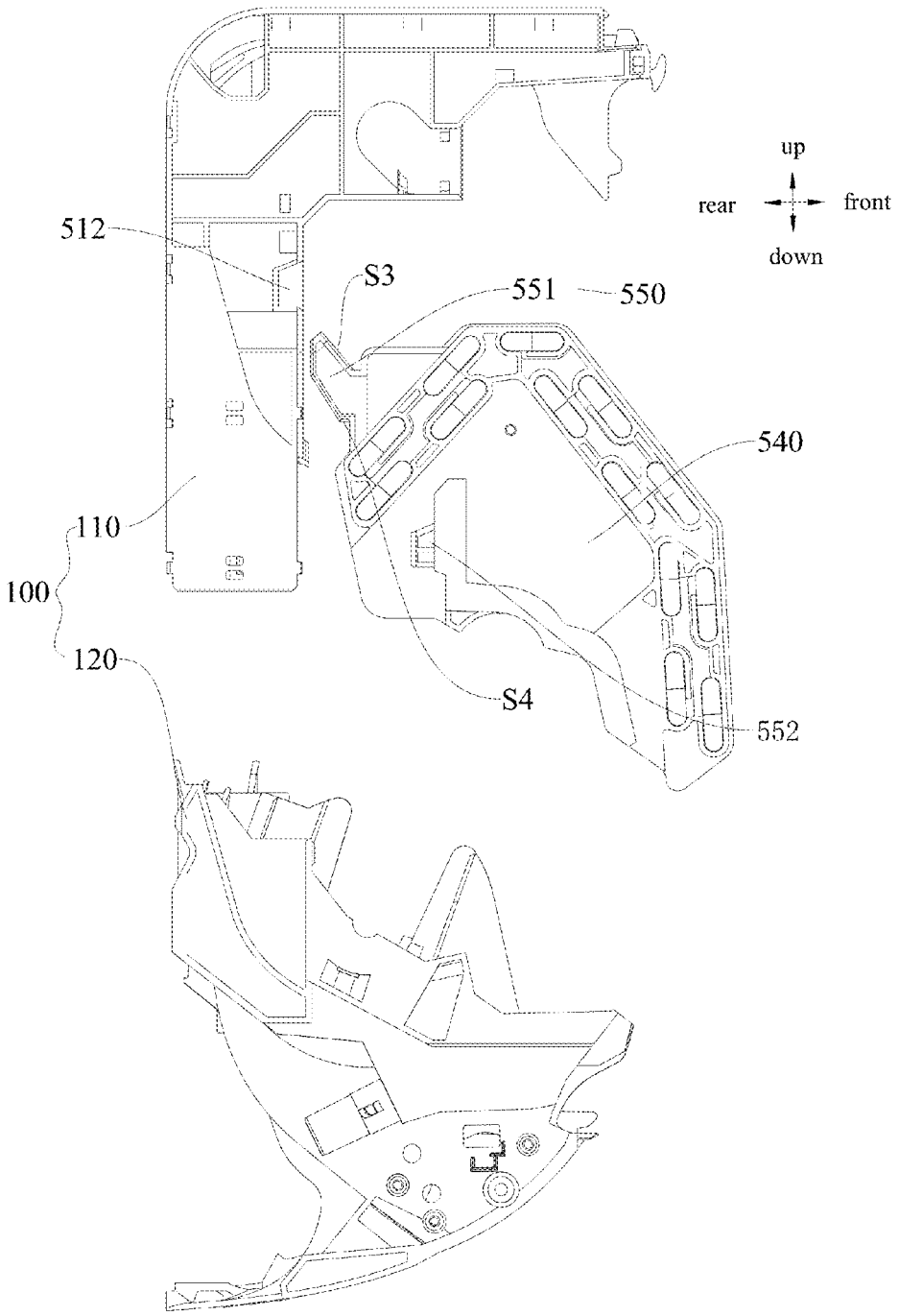
FIG. 18 is a schematic view showing a disconnected structure of base plates and a supporting seat according to an embodiment of the present invention.

Specifically, as shown in FIG. 18, the hanging element 551 protrudes beyond an outer edge of the supporting seat 540 and obliquely extends upwards from front to rear, the hanging element 551 has a supporting plane S4 at a bottom thereof, and the supporting plane S4 is supported on a bottom wall of the hanging groove 511. In such a way, after the hanging element 551 is assembled in place, the supporting seat 540 will not fall off from the base plate easily, thus facilitating further fixing of the supporting seat 540.

More specifically, as shown in FIGS. 18 and 19, an upper portion of the hanging element 551 has an inclined surface S3, a top portion of the hanging groove 511 is provided with a fitting surface S1, and the inclined surface S3 and the fitting surface S1 abut against each other to position the hanging element 551 in the hanging groove 511. Thus, the supporting seat 540 is not prone to shake due to the fit of the inclined surface S3 and the fitting surface S1, and will not fall off easily after the hanging element 551 is assembled in place.

Advantageously, as shown in FIGS. 18 and 19, a front end of the fitting surface S1 is provided with a guiding surface F, and an angle between the guiding surface F and a vertical direction is larger than an angle between the fitting surface S1 and the vertical direction, so that the guiding surface F plays a role of guiding and thus facilitates assembling the hanging element 551 upwards along the guiding surface F. After the hanging element 551 is assembled in place, the hanging element 551 is fitted with the fitting surface S1 closely.

Alternatively, as shown in FIG. 18, an upper end of a rear wall 654 of the supporting seat 540 is higher than a lower end of the hanging element 551, such that a top wall of the hanging groove 551 abuts against the rear wall 654 of the supporting seat 540.

Further, as shown in FIG. 18, the supporting seat 540 is further provided with a positioning protrusion 552, and the upper base plate 110 is provided with a positioning groove 512. The positioning protrusion 522 is fitted in the positioning groove 512, so as to further facilitate assembling and positioning of the supporting seat 540 and the upper base plate 110 and to make the positioning of the supporting seat 540 more reliable.

Alternatively, as shown in FIG. 18, the positioning groove 512 has a trapezoid shape, and a shape of the positioning protrusion 522 is matched with that of the positioning groove 512.

In a specific embodiment, as shown in FIGS. 20-37, the supporting seat 540 is provided at a left end of the heat exchanger core body 530. For the sake of distinct descriptions, the supporting seat 540 at a left end of the heat exchanger 140 is regarded as a left supporting seat 650, while a right connecting plate 660 is provided at a right end of the heat exchanger 140. The left supporting seat 650 is provided with a left hanging element 651, a left hanging groove 610 is provided in the upper base plate 110, and the left hanging element 651 is fitted in the left hanging groove 610 to hang the left supporting seat 650 to the upper base plate 110. A water receiving cover 670 is disposed at the right connecting plate 660 and provided with a right hanging element 671, a right hanging groove 630 is provided in the upper base plate 110, and the right hanging element 671 is fitted in the right hanging groove 630 to hang the water receiving cover 670 to the upper base plate 110.

In short, the left end of the heat exchanger 140 may be assembled with the upper base plate 110 through the left supporting seat 650 and the fit of the left hanging element 651 and the left hanging groove 610, and the right end of the heat exchanger 140 may be assembled with the upper base plate 110 through the right connecting plate 660, the water receiving cover 670, and the fit of the right hanging element 671 and the right hanging groove 630. Consequently, the heat exchanger 140 may be assembled to or disassembled from the upper base plate 110 easily and conveniently, thus greatly facilitating the maintenance, repair and cleaning of the indoor unit 1000.

In an embodiment of the present invention, with reference to FIGS. 23-27, the left hanging element 651 protrudes beyond an outer edge of the left supporting seat 650 and obliquely extends upwards from front to rear, and the right hanging element 671 protrudes beyond an outer edge of the water receiving cover 670 and obliquely extends upwards from front to rear, such that structures of the left hanging element 651 and the right hanging element 671 are approximately bilaterally symmetrical, so that forces in the identical direction may be applied to left and right sides of the heat exchanger 140 at the same level during the mounting of the heat exchanger 140, so as to assemble the heat exchanger 140 to the upper base plate 110 conveniently and effortlessly.

Further, with reference to FIGS. 29-37, a bottom of the left hanging element 651 has a left supporting plane 652 and the left supporting plane 652 is supported on a bottom wall 611 of the left hanging groove 610. A bottom of the right hanging element 671 has a right supporting plane 672 and the right supporting plane 672 is supported on a bottom wall 631 of the right hanging groove 630. In such a way, after the left hanging element 651 and the right hanging element 671 are assembled in place, the upper base plate 110 may support the left hanging element 651 stably since the left supporting plane 652 is supported on the bottom wall 611 of the left hanging groove 610, and the upper base plate 110 may also support the right hanging element 671 since the right supporting plane 672 is supported on the bottom wall 631 of the right hanging groove 630, which enhances the supporting strength, avoids shaky connection and unstable mounting, and improves the working reliability of the heat exchanger 140 effectively.

Further, with reference to FIGS. 29-37, an upper portion of the left hanging element 651 has a left inclined surface 653, a top portion of the left hanging groove 610 is provided with a left fitting surface 613, and the left inclined surface 653 and the left fitting surface 613 abut against each other to position the left hanging element 651 in the left hanging groove 610. An upper portion of the right hanging element 671 has a right inclined surface 673, a top portion of the right hanging groove 630 is provided with a right fitting surface 632, and the right inclined surface 673 and the right fitting surface 632 abut against each other to position the right hanging element 671 in the right hanging groove 630. In such a way, a problem of over-fitting of the left hanging element 651 and the left hanging groove 610 may be avoided by the fit of the left inclined surface 653 and the left fitting surface 613, and a problem of over-fitting of the right hanging element 671 and the right hanging groove 630 may be avoided by the fit of the right inclined surface 673 and the right fitting surface 632. Moreover, since these two pairs of inclined surfaces and fitting surfaces are fitted with and abut against each other, the mounting position of the heat exchanger 140 is accurate, and the heat exchanger 140 may be reliably mounted to the upper base plate 110.

Furthermore, the upper portion of the left hanging element 651 may be limited by the fit of the left fitting surface 613 and the left inclined surface 653, and a lower portion of the left hanging element 651 may be limited by the left supporting plane 652, such that the left hanging element 651 may be well limited in the up and down direction, thus achieving accurate positioning and reliable limitation of the left end of the heat exchanger 140. Correspondingly, the upper portion of the right hanging element 671 may be limited by the fit of the right fitting surface 632 and the right inclined surface 673, and a lower portion of the right hanging element 671 may be limited by the right supporting plane 672, such that the right hanging element 671 may be limited in the up and down direction, thus achieving accurate positioning and reliable limitation of the right end of the heat exchanger 140.

With reference to FIGS. 29-37, a front end of the left fitting surface 613 is provided with a left guiding surface 614, i.e., the left guiding surface 614 is provided at a lower front side of the left fitting surface 613, and an angle between the left guiding surface 614 and the vertical direction is larger than an angle between the left fitting surface 613 and the vertical direction. Thus, in the process of assembling the left hanging element 651, the left hanging element 651 may first be pushed rearwards along the left guiding surface 614 having a larger flare angle, and then rotated around a rotation fulcrum, i.e., an intersection of the left guiding surface 614 and the left fitting surface 613, so that the left inclined surface 653 is fitted with and abuts against the left fitting surface 613, and the left supporting plane 652 is supported on the bottom wall 611 of the left hanging groove 610, thus completing the assembling of the left hanging element 651. By providing the left guiding surface 614, the difficulty of assembling the left hanging element 651 is effectively lowered and the assembling efficiency thereof is improved.

With reference to FIGS. 29-37, a front end of the right fitting surface 632 is provided with a right guiding surface 633, i.e., the right guiding surface 633 is provided at a lower front side of the right fitting surface 632, and an angle between the right guiding surface 633 and the vertical direction is larger than an angle between the right fitting surface 632 and the vertical direction. Thus, in the process of assembling the right hanging element 671, the right hanging element 671 may first be pushed rearwards along the right guiding surface 633 having a larger flare angle, and then rotated around a rotation fulcrum, i.e., an intersection of the right guiding surface 633 and the right fitting surface 632, so that the right inclined surface 673 is fitted with and abuts against the right fitting surface 632, and the right supporting plane 672 is supported on the bottom wall 631 of the right hanging groove 630, thus completing the assembling of the right hanging element 671. By providing the right guiding surface 633, the difficulty of assembling the right hanging element 671 is effectively lowered and the assembling efficiency thereof is improved.

An upper end of a rear wall of the left supporting seat 650 is higher than a lower end of the left hanging element 651, such that a top wall 612 of the left hanging groove 610 abuts against the rear wall of the left supporting seat 650. An upper end of a rear wall of the water receiving cover 670 is higher than a lower end of the right hanging element 671, such that a top wall of the right hanging groove 630 abuts against the rear wall of the water receiving cover 670. Consequently, since the top wall 612 of the left hanging groove 610 is supported on the rear wall of the left supporting seat 650 and the top wall of the right hanging groove 630 is supported on the rear wall of the water receiving cover 670, the upper base plate 110 may limit a rearwards movement of the left hanging element 651 via the left hanging groove 610, and also limit a rearwards movement of the right hanging element 671 via the right hanging groove 630, so as to ensure that the heat exchanger 140 is mounted stably without rearwards displacements.

Preferably, the left supporting seat 650 is further provided with an inserting connection clasp 655, the upper base plate is provided with an inserting connection groove 620, and the inserting connection clasp 655 is fitted in the inserting connection groove 620. As shown in examples of FIGS. 23 and 32, the inserting connection clasp 655 may protrude rearwards and the inserting connection groove 620 may be recessed rearwards. When the left hanging element 651 and the left hanging groove 610 are assembled in place, the inserting connection clasp 655 may be fitted into the inserting connection groove 620 incidentally. In such a way, the reliability of connecting the left supporting seat 650 with the upper base plate may be further improved by the fit of the inserting connection clasp 655 and the inserting connection groove 620.

Two right hanging elements 671 are provided and spaced apart from each other in the left and right direction, and also, two right hanging grooves 630 are provided in the upper base plate and spaced apart from each other in the left and right direction, such that the two right hanging elements 671 may be fitted in the two right hanging grooves 630 respectively, so as to further improve the reliability of connecting the right end of the heat exchanger 140 with the upper base plate.

Consequently, in the process of assembling the heat exchanger 140, the left hanging element 651 of the left supporting seat 650 may be inserted into the left hanging groove 610, and the right hanging element 671 of the water receiving cover 670 may be inserted into the right hanging element 630. Then, the heat exchanger 140 is rotated around two rotation fulcrums, namely the intersection of the left guiding surface 614 and the left fitting surface 613 and the intersection of the right guiding surface 633 and the right fitting surface 632. When the left inclined surface 653 is fitted with the left fitting surface 613 in place, the left supporting plane 652 is supported on the bottom wall 611 of the left hanging groove 610, and the inserting connection clasp 655 is fitted in the inserting connection groove 620. When the right inclined surface 673 is fitted with the right fitting surface 632 in place, the right supporting plane 672 is supported on the bottom wall 631 of the right hanging groove 630, and a first fitting hole 640 in the upper base plate 110 clings to and is aligned with a second fitting hole 676 in the water receiving cover 670. Thus, the assembling process is completed, and it just needs to fasten the first fitting hole 640 with the second fitting hole 676 by a screw. In such a way, the heat exchanger 140 and the upper base plate 110 may be firmly fixed together only via snap structures and one screw. In the assembling process, the mounting just needs to be completed along with the rotating movement, which is very convenient to operate.

The water receiving cover 670 is provided with a retaining protrusion 674, a retaining hole 661 is provided in the right connecting plate 660, and the retaining protrusion 674 is fitted with the retaining hole 661 to position the water receiving cover 670 to the right connecting plate 660. With reference to FIGS. 20 to 37, the retaining hole 661 may run through the right connecting plate 660 along the left and right direction, and the retaining protrusion 674 may protrude rightwards from a left wall of the water receiving cover 670. During the assembling, the left wall of the water receiving cover 670 may be mounted to a left side of the right connecting plate, and the retaining protrusion 674 may be ensured to protrude rightwards from the retaining hole 661, so that the right connecting plate and the water receiving cover 670 can be positioned reliably without relative displacement. Certainly, the present invention is not limited to this. The positions of the retaining protrusion 674 and the retaining hole 661 may be configured in the light of practical requirements to well satisfy the practical requirements.

Further, the water receiving cover 670 is further fastened to the right connecting plate 660 via a screw. For example, the water receiving cover 670 is provided with a screw connection column 675 and a screw connection hole is formed in a corresponding position of the right connecting plate 660. When the right connecting plate 660 and the water receiving cover 670 are assembled in place, the screw connection column 675 is opposed to the screw connection hole, such that the screw may be screwed into the corresponding screw connection hole and screw connection column 675 to firmly fix the right connecting plate 660 with the water receiving cover 670.

In some embodiments, as shown in FIGS. 38 to 46, the indoor unit 1000 includes a pipe-routing press strip 190. The housing 100 is configured as a supporting frame of the indoor unit 1000 and components in the indoor unit 1000 are directly or indirectly mounted to the housing 100.

Specifically, the heat exchanger 140 may be a condenser or an evaporator. If the heat exchanger 140 is configured as the condenser, the indoor unit 1000 may heat up an indoor environment. If the heat exchanger 140 is configured as the evaporator, the indoor unit 1000 may cool down the indoor environment.

The heat exchanger 140 is connected with an input-output pipe 198, and the input-output pipe 198 is configured as a channel through which the refrigerant enters or leaves the heat exchanger 140. The input-output pipe 198 may include two pipes, one of which is used to introduce the refrigerant into the heat exchanger 140 from an outdoor unit, and the other of which is used to guide the refrigerant that has exchanged heat with the indoor environment to the outdoor unit from the heat exchanger 140.

The fan wheel 143 is mounted in the housing 100 and located below the heat exchanger 140. When the indoor unit 1000 operates, the fan wheel 143 rotates at a high speed to suck air in the indoor environment into the housing 100, and the air is exhausted from the air outlet after exchanging heat with the heat exchanger 140.

Figure 38:
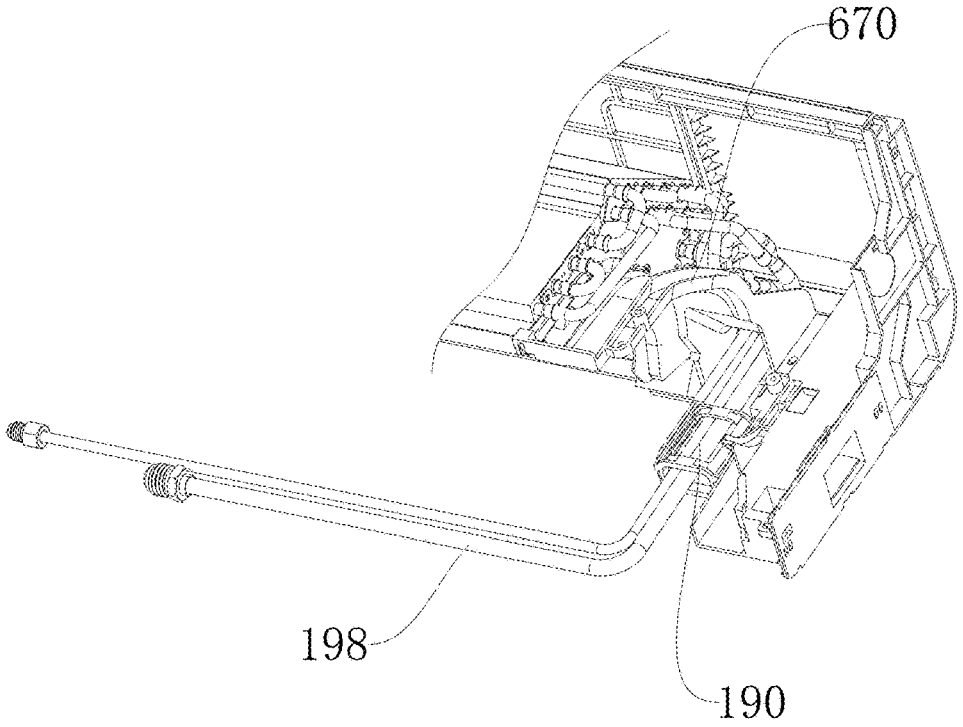
FIG. 38 is a partial schematic view of an upper base plate, a heat exchanger, a water receiving cover and a pipe-routing press strip fitted with one another in a direction according to an embodiment of the present invention.
Figure 39:
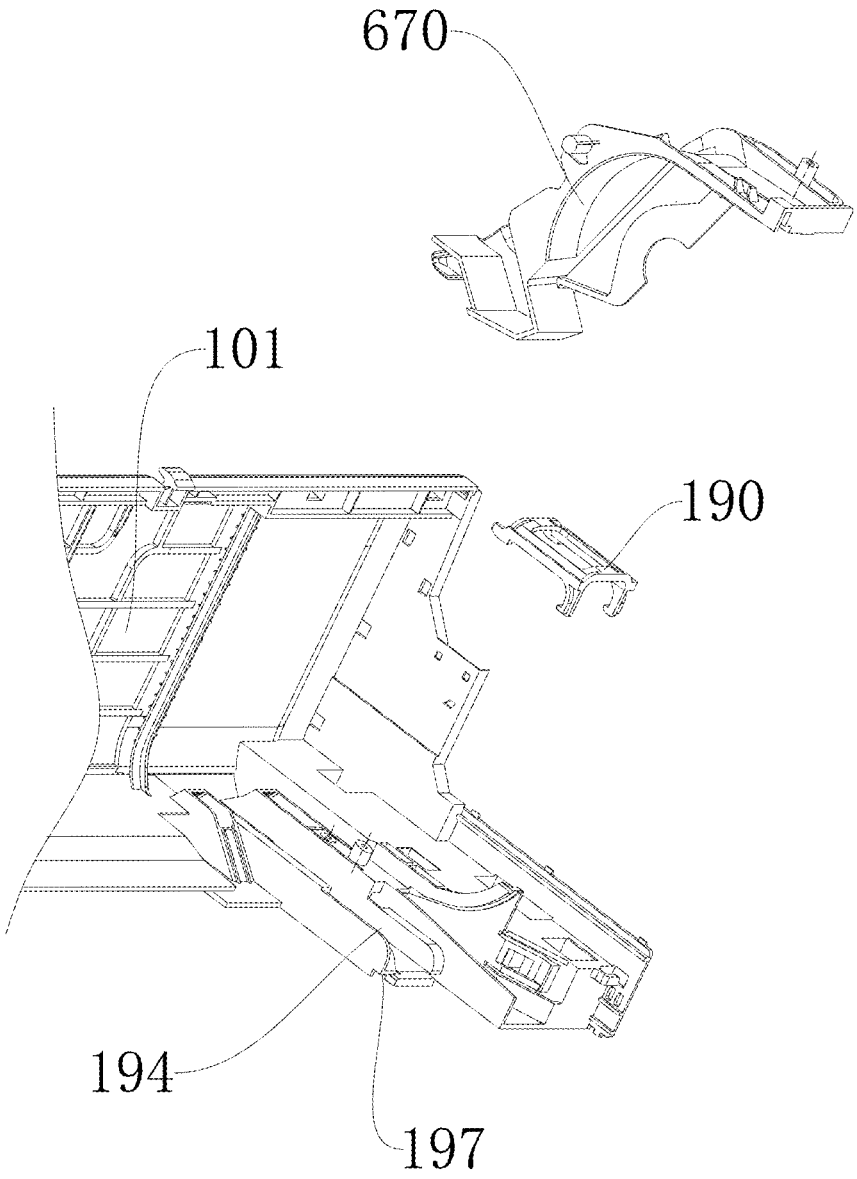
FIG. 39 is a partial exploded view of an upper base plate, a water receiving cover and a pipe-routing press strip according to an embodiment of the present invention.

As shown in FIG. 38, in combination with FIG. 39, the pipe-routing press strip 190 is mounted at an inner surface of the housing 100 and presses the input-output pipe 198 against the inner surface of the housing 100. Thus, the pipe-routing press strip 190 may at least partially wrap the input-output pipe 198 connected to the heat exchanger 140, so as to protect the input-output pipe 198 effectively and avoid damage of the input-output pipe 198 to a certain extent, thus prolonging the service life thereof to a certain extent.

Figure 45:
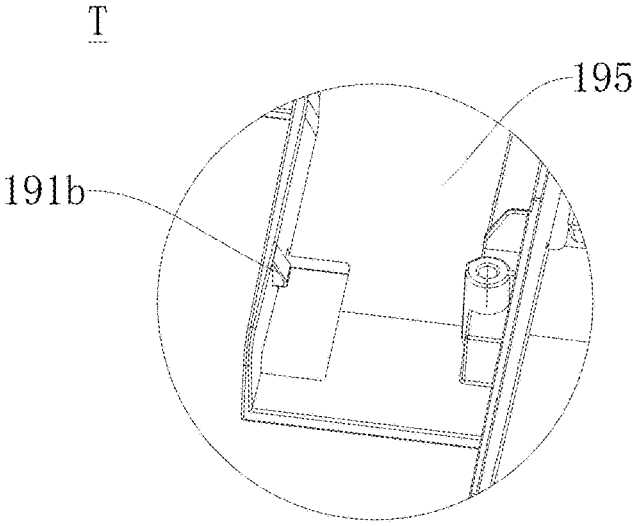
FIG. 45 is a partially enlarged view of part T in FIG. 44.

In some embodiments of the present invention, as shown in FIGS. 39 to 44, in combination with FIG. 45, an inserting column 191 and a snap hook 192 are provided at two ends of the pipe-routing press strip 190 respectively, the housing 100 is provided with an inserting groove 194 and a snap step 197, and the inserting column 191 is inserted in the inserting groove 194 while the snap hook 192 is hung to the snap step 197. In such a way, the pipe-routing press strip 190 may press the input-output pipe 198 against the inner surface of the housing 100.

Figure 42:
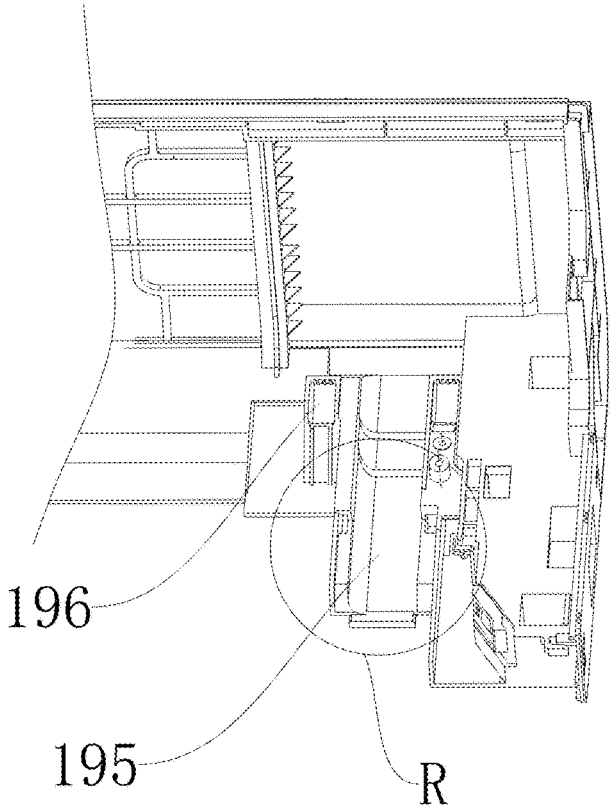
FIG. 42 is a partial schematic view of an upper base plate according to an embodiment of the present invention.
Figure 43:
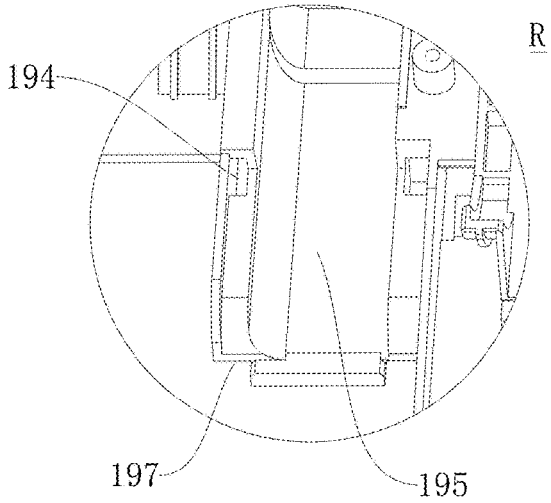
FIG. 43 is a partially enlarged view of part R in FIG. 42.
Figure 44:
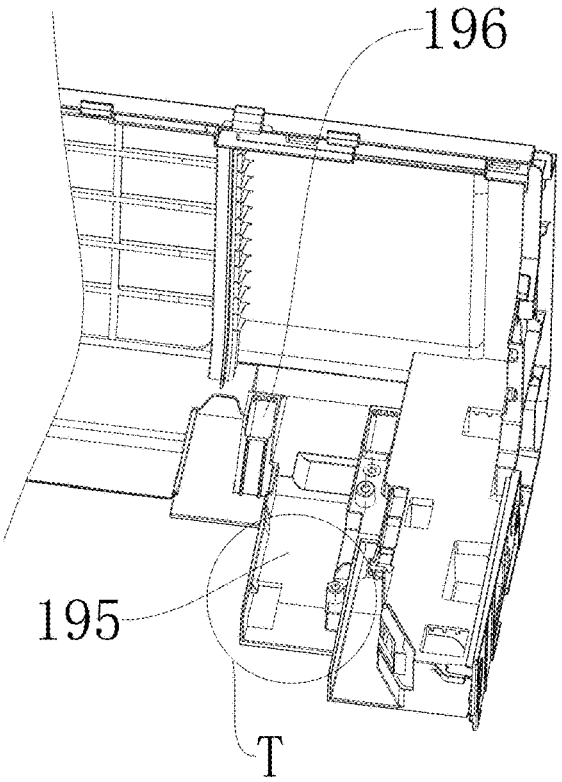
FIG. 44 is a partial schematic view of an upper base plate according to another embodiment of the present invention.
Figure 46:
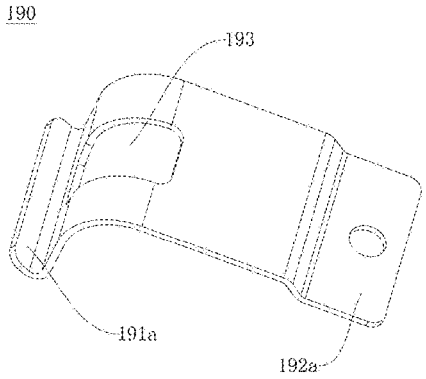
FIG. 46 is a schematic view of a pipe-routing press strip according to another embodiment of the present invention.
Figure 47:
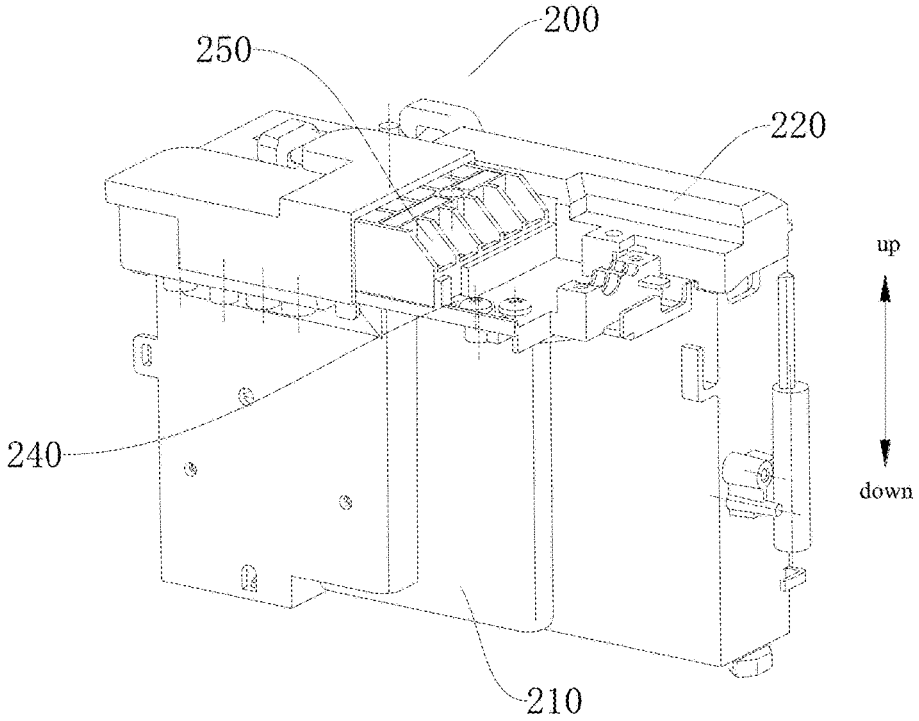
FIG. 47 is a schematic view of an electric control box assembly according to an embodiment of the present invention.

Further, as shown in FIGS. 45 and 46, in combination with FIG. 42, a pipe-through groove 195 is provided in the inner surface of the housing 100, and the pipe-routing press strip 190 presses the input-output pipe 198 into the pipe-through groove 195.

After the input-output pipe 198 is connected with the heat exchanger 140, the input-output pipe 198 may be placed in the pipe-through groove 195, then the inserting column 191 of the pipe-routing press strip 190 is inserted in the inserting groove 194 of the housing 100, and the snap hook 192 of the pipe-routing press strip 190 is hung to the snap step 197, so that the input-output pipe 198 is pressed in the inserting groove 194.

In some other embodiments of the present invention, as shown in FIGS. 45 and 46, a snap strip 191*a* and a mounting plate 192*a* may be provided at the two ends of the pipe-routing press strip 190 respectively, and the housing 100 is provided with a clamping portion 191*b*. The snap strip 191*a* is connected with the clamping portion 191*b* in a clamping manner, and the mounting plate 192*a* is mounted to the housing 100 via a first threaded fastener. Thus, the pipe-routing press strip 190 is firmly fitted with the housing 100, thereby tightly pressing the input-output pipe 198.

Alternatively, as shown in FIG. 46, the pipe-routing press strip 190 is provided with a window 193 running through the pipe-routing press strip 190 along a thickness direction thereof, and a part of the input-output pipe 198 pressed by the pipe-routing press strip 190 is exposed out of the pipe-routing press strip 190 via the window 193.

Consequently, the weight and the material consumption of the pipe-routing press strip 190 are reduced, while the strength of the pipe-routing press strip 190 is guaranteed, which lowers the cost of the indoor unit 1000 to a certain extent.

During the refrigeration of the indoor unit 1000, the temperature of the refrigerant in the heat exchanger 140 is relatively low, so condensed water may be generated on the heat exchanger 140. In order to prevent the condensed water from affecting the operation of the indoor unit 1000, in some embodiments of the present invention, as shown in FIGS. 38 to 46, the air conditioner further includes the water receiving cover 670 that is mounted in the housing 100 and located between the heat exchanger 140 and the fan 142. The water receiving cover 670 receives the condensed water generated by the heat exchanger 140 and guides the condensed water to the outside.

Specifically, a sliding groove 196 is provided in the housing 100, the water receiving cover 670 is provided with a sliding rail, and the sliding rail is slidably hung in the sliding groove 196. Thus, it is convenient to mount the water receiving cover 670 to the housing 100, which improves the efficiency of assembling the indoor unit 1000.

Preferably, when being hung to the housing 100, the water receiving cover 670 may be fixed to the housing 100 by a fourth threaded fastener, so as to improve the stability of the water receiving cover 670 and guarantee the safe and stable operation of the indoor unit 1000.

Figure 40:
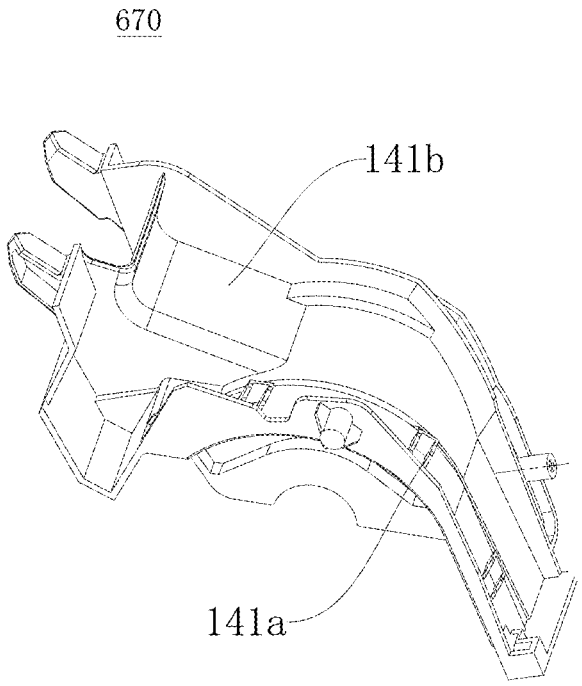
FIG. 40 is a schematic view of a water receiving cover according to an embodiment of the present invention.
Figure 41:
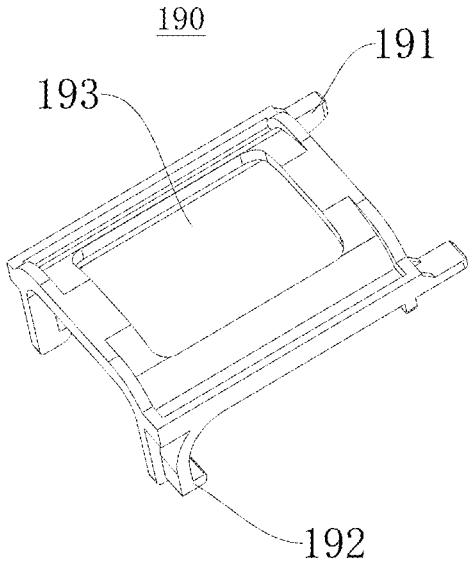
FIG. 41 is a schematic view of a pipe-routing press strip according to an embodiment of the present invention.

In some embodiments of the present invention, as shown in FIG. 40, a pipe-through port 141*b* is provided in the water receiving cover 670, and the input-output pipe 198 passes through the pipe-through port 141*b*. The size and shape of the pipe-through port 141*b* may be designed according to specific situations as long as it is ensured that the water receiving cover 670 have enough strength.

Further, as shown in FIG. 40, the water receiving cover 670 is provided with a water-receiving-cover position limiting protrusion 141*a*, and the heat exchanger 140 is stopped by the water-receiving-cover position limiting protrusion 141*a*. The water-receiving-cover position limiting protrusion 141*a* may be used to support the heat exchanger 140 and prevent the heat exchanger 140 from being displaced in the left and right direction to a certain extent.

In some embodiments, as shown in FIGS. 47 to 56, the indoor unit 1000 further includes an electric control box assembly 200 that includes an electric control box body 210, an electric control box lid 220, an electric control printed circuit board 230, a ground sheet 240 and a wire holder 250. Specifically, the electric control box lid 220 is provided at a top of the electric control box body 210, the electric control printed circuit board 230 is provided in the electric control box body 210 and arranged along the vertical direction (e.g. the up and down direction shown in FIG. 48), the ground sheet 240 is provided at the top of the electric control box body 210, and the wire holder 250 also is provided at the top of the electric control box body 210 and located on the ground sheet 240.

In other words, the electric control box assembly 200 mainly includes the electric control box body 210, the electric control box lid 220, the electric control printed circuit board 230, the ground sheet 240 and the wire holder 250. The electric control box body 210 is provided with the electric control printed circuit board 230, the ground sheet 240 and the wire holder 250 therein. The electric control box lid 220 is provided over the top of the electric control box body 210. Specifically, the electric control printed circuit board 230 is configured as a board body by extending along the vertical direction, and has two ends connected with the electric control box body 210. The ground sheet 240 is provided at the top of the electric control box body 210, and the wire holder 250 is provided on the ground sheet 240.

Consequently, for the electric control box assembly 200 according to embodiments of the present invention, since the electric control box body 210 and the electric control box lid 220 of the electric control box assembly 200 are configured as separate structures, the electric control printed circuit board 230, the ground sheet 240 and the wire holder 250 can be mounted in the electric control box body 210 in order respectively, which provides a simple and compact structure, and is convenient to assemble or disassemble and easy to operate.

Specifically, according to an embodiment of the present invention, a mounting groove 211 is formed in each of two opposite inner walls of the electric control box body 210, and the two ends of the electric control printed circuit board 230 extend into corresponding mounting grooves 211, respectively.

Figure 48:
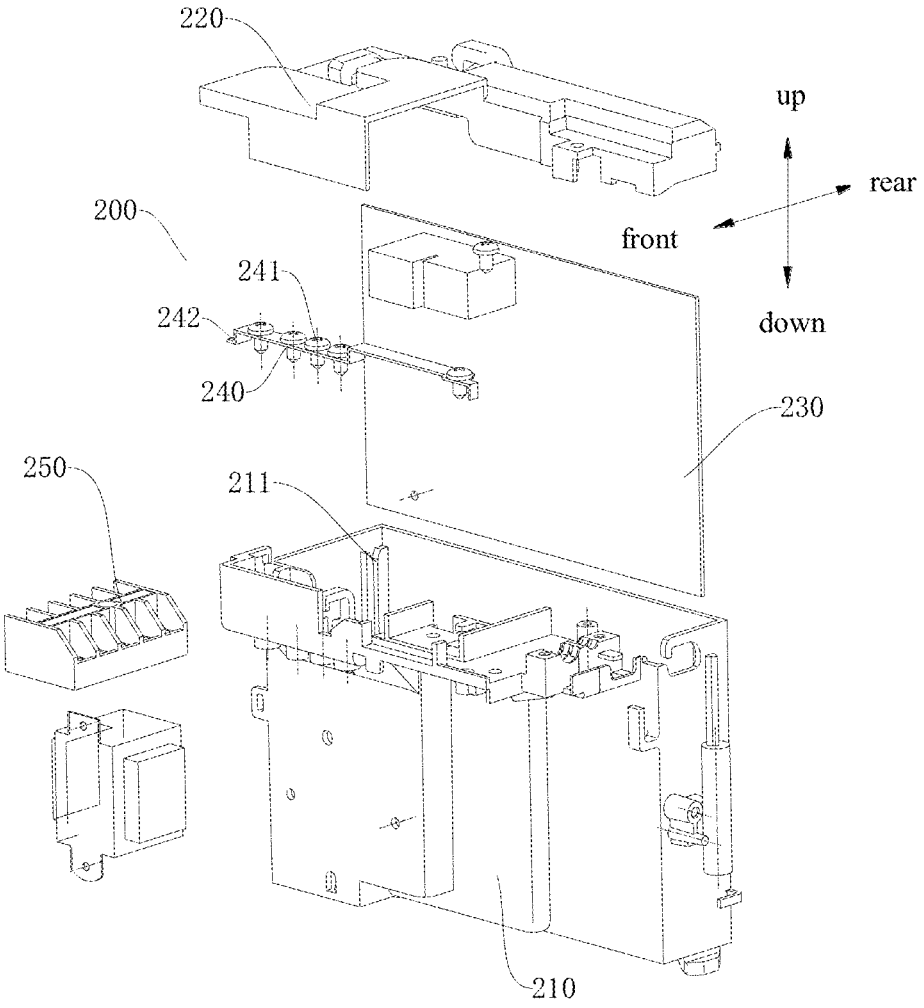
FIG. 48 is an exploded view of an electric control box assembly according to an embodiment of the present invention.

As shown in FIG. 48, the electric control box body 210 is configured as a substantially rectangular box body, and the mounting groove 211 is formed in each of the two opposite inner walls of the electric control box body 210 and extends along the vertical direction of the electric control box body 210. The two ends of the electric control printed circuit board 230 are clamped in the two opposite mounting grooves 211 of the electric control box body 210. Preferably, each of upper and lower ends of the mounting groove 211 has a V shape to facilitate mounting the electric control printed circuit board 230. In this embodiment, a width (for example, a size in the front and rear direction shown in FIG. 48) of the mounting groove 211 is larger than or equal to a thickness of the electric control printed circuit board 230.

Therefore, by providing the mounting grooves 211 in the two opposite inner walls of the electric control box body 210, the electric control printed circuit board 230 may be fixedly mounted in the electric control box body 210, which improves the utilization rate of the mounting space effectively, guarantees the structural stability of the electric control box assembly 200, prevents the electric control printed circuit board 230 from falling off from the electric control box body 210 and thus guarantees the normal operation of the indoor unit 1000. Moreover, the electric control printed circuit board 230 may be mounted or dismounted from the front side, to facilitate the assembling and disassembling of the electric control box assembly 200.

Alternatively, according to an embodiment of the present invention, an extension part 212 is provided at the top of the electric control box body 210 and extends in a direction running away from a center of the electric control box body 210, in which the ground sheet 240 and the wire holder 250 are provided on the extension part 212.

Figure 50:
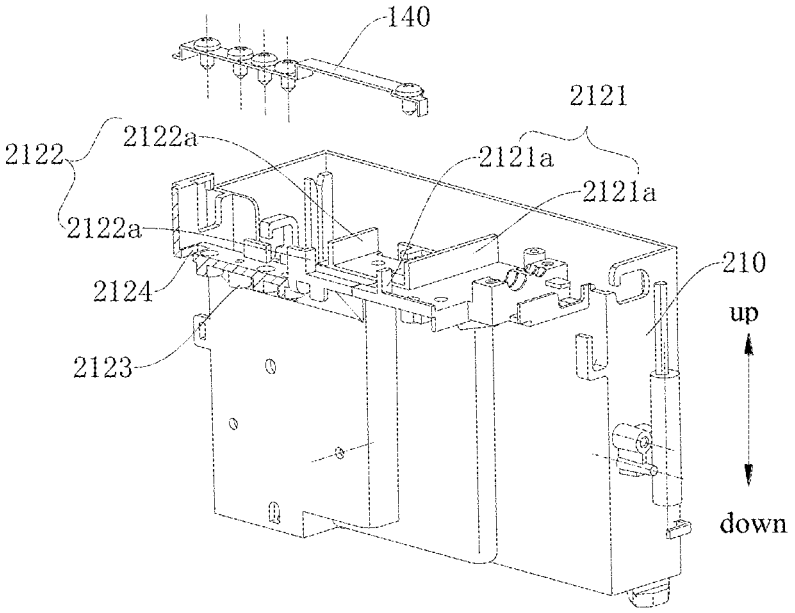
FIG. 50 is an exploded view of an electric control box body of an electric control box assembly according to an embodiment of the present invention.

As shown in FIG. 50, according to an embodiment of the present invention, the extension part 212 is provided with a first position limiting rib 2121, and the first position limiting rib 2121 includes two first position limiting sub-ribs 2121*a* that are spaced apart from each other in a width direction of the ground sheet 240.

Figure 51:
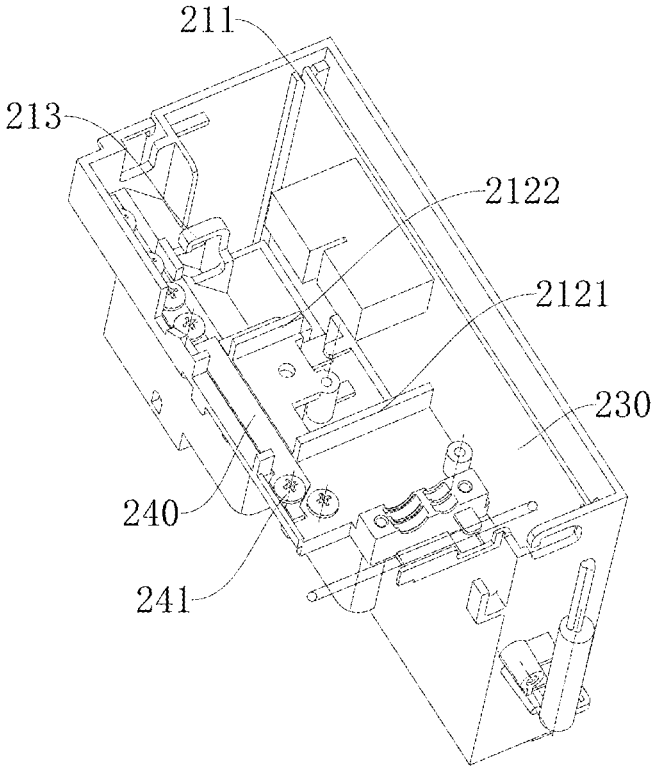
FIG. 51 is an assembly view of an electric control box body and an electric control printed circuit board of an electric control box assembly according to an embodiment of the present invention.

According to an embodiment of the present invention, as shown in FIGS. 50 to 51, the extension part 212 is provided with a second position limiting rib 2122 spaced apart from the first position limiting rib 2121 in a length direction of the ground sheet 240, and the second position limiting rib 2122 includes two second position limiting sub-ribs 2122*a* that are spaced apart from each other in the width direction of the ground sheet 240. The wire holder 250 is provided between the first position limiting rib 2121 and the second position limiting rib 2122.

Specifically, the extension part 212 is provided with the first position limiting rib 2121 and the second position limiting rib 2122 that are spaced apart from each other along the length direction of the ground sheet 240. The first position limiting rib 2121 mainly consists of two first position limiting sub-ribs 2121*a* spaced apart from each other in the width direction of the ground sheet 240, while the second position limiting rib 2122 mainly consists of two second position limiting sub-ribs 2122*a* that are spaced apart from each other in the width direction of the ground sheet 240. The wire holder 250 is provided on the ground sheet 240 and clamped between the first position limiting rib 2121 and the second position limiting rib 2122.

Consequently, by providing the extension part 212 with the first position limiting rib 2121 and the second position limiting rib 2122 that are spaced apart from each other, and providing the wire holder 250 clamped between the first position limiting rib 2121 and the second position limiting rib 2122, the wire holder 250 may be mounted to the extension part 212 stably, which provides a simple structure and a low cost, and is convenient to assemble and easy to implement.

According to an embodiment of the present invention, the ground sheet 240 is provided with at least one ground screw 241, and the extension part 212 is provided with at least one seal sleeve 2123 fitted with the at least one ground screw 241. According to an embodiment of the present invention, a plurality of ground screws 241 are provided and spaced apart from one another along the length direction of the ground sheet 240.

As shown in FIGS. 48 to 53, in this embodiment, the ground sheet 240 is provided with the plurality of ground screws 241, while the extension part 212 is provided with a plurality of seal sleeves 2123 arranged along the length direction of the ground sheet 240. The number of the ground screws 241 on the ground sheet 240 is equal to that of the seal sleeves 2123 of the extension part 212. The plurality of ground screws 241 are fitted with the plurality of seal sleeves 2123 of the extension part 212 in one to one correspondence.

Alternatively, according to an embodiment of the present invention, a snap piece 242 is provided at at least one of two ends of the ground sheet 240 along the length direction thereof, and the extension part 212 is provided with a snap groove 2124 fitted with the snap piece 242.

Specifically, as shown in FIG. 48, the ground sheet 240 substantially has a strip shape. The snap piece 242 is provided at one end of the ground sheet 240 along the length direction thereof, while the snap groove 2124 is provided in a position of the extension part 212 where the extension part 212 is fitted with the end of the ground sheet 240. When the ground sheet 240 is mounted to the extension part 212, the snap piece 242 of the ground sheet 240 is snapped into the snap groove 2124 of the extension part 212. Certainly, in this embodiment, the snap piece 242 may be provided at each of the two ends of the ground sheet 240. Correspondingly, the extension part 212 is provided with snap grooves 2124 fitted with the two snap pieces 242 of the ground sheet 240. Further, the ground sheet 240 is connected to the extension part 212 via a second threaded fastener.

In some specific embodiments of the present invention, the snap piece 242 is formed by bending a part of the ground sheet 240. That is, the snap piece 242 is integrally formed with the ground sheet 240. It can be understood that the snap piece 242 may be directly formed to the ground sheet 240 during the molding of the ground sheet 240. The integrally formed structure guarantees the structural stability of the ground sheet 240 and is convenient to mold at a low cost, and also makes the structure of the whole electric control box assembly 200 compact.

In this embodiment, the ground sheet 240 employs four ground screws 241, and adapts to various grounding manners. Moreover, one side of the ground sheet 240 is fixed with the snap groove 2124 of the electric control box body 210 via the snap piece 242, the other side thereof is fixed with the snap groove 2124 of the electric control box body 210 via a vertical rib, and a middle part thereof is fixed to a screw column of the electric control box body 210 via the ground screw 241. Moreover, the ground sheet 240 is pressed by the wire holder 250, and the wire holder 250 is an existing wire holder in the prior art, thus facilitating wiring by a user.

Figure 52:
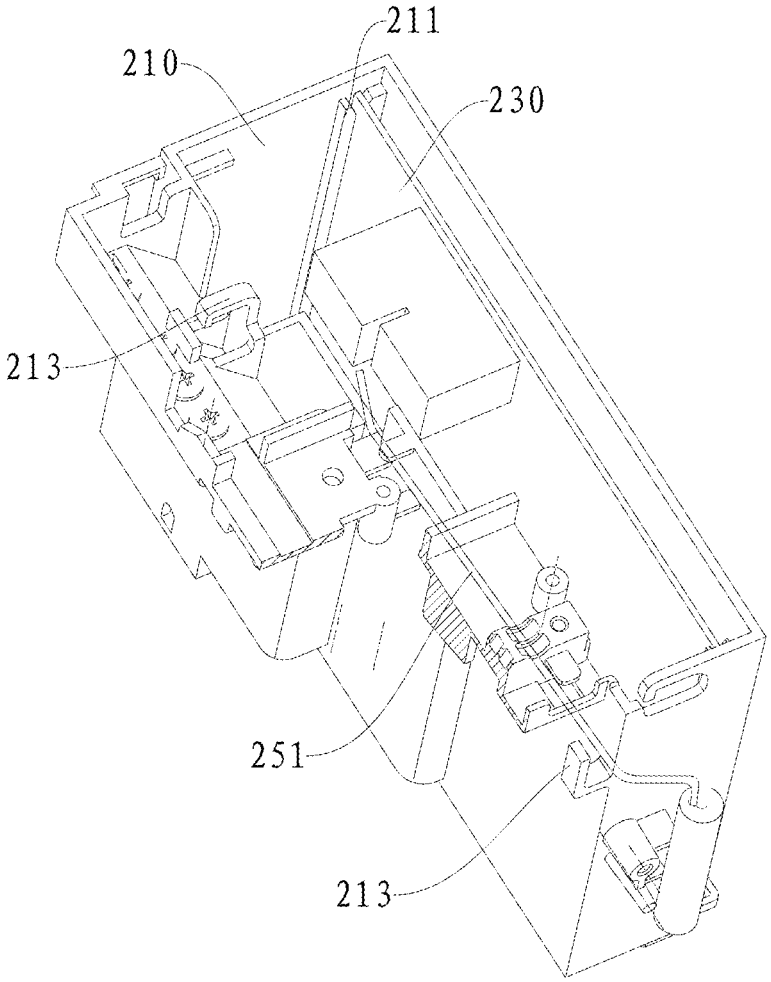
FIG. 52 is an assembly view of an electric control box body and an electric control printed circuit board of an electric control box assembly according to another embodiment of the present invention.
Figure 53:
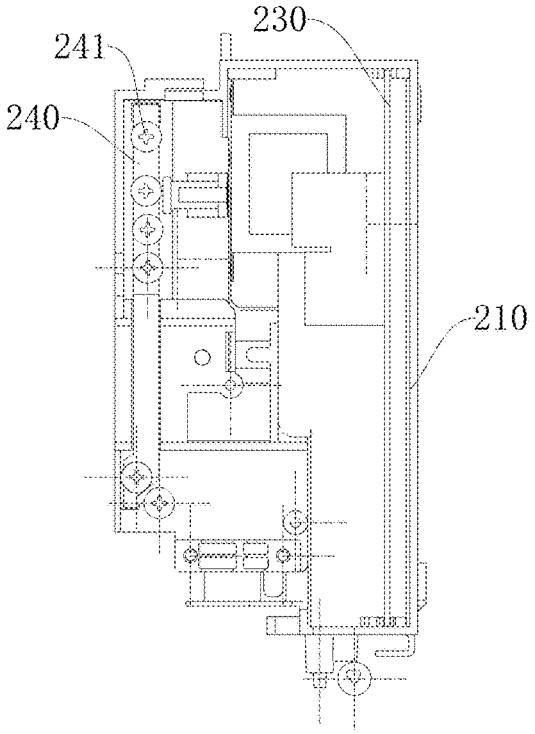
FIG. 53 is a top view of an electric control box body of an electric control box assembly according to an embodiment of the present invention.
Figure 54:
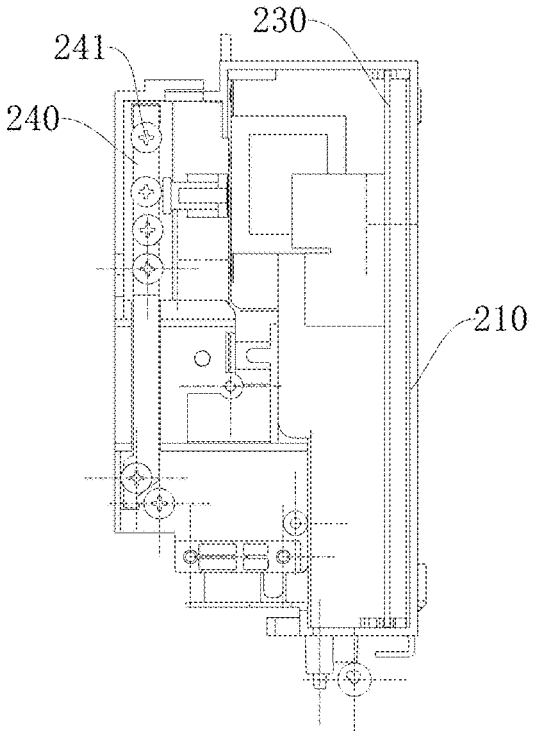
FIG. 54 is a top view of an electric control box body of an electric control box assembly according to another embodiment of the present invention.
Figure 55:
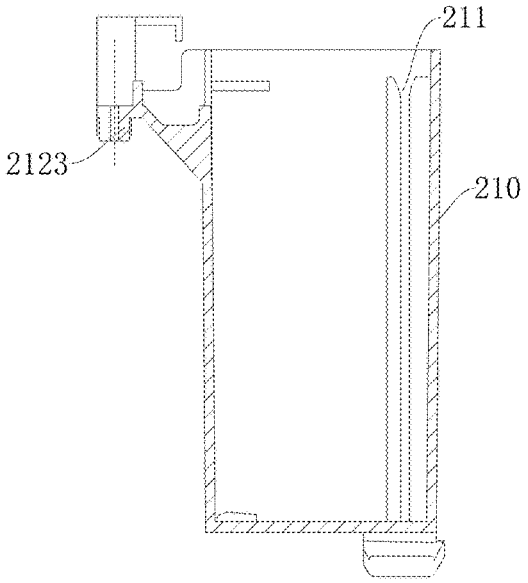
FIG. 55 is a sectional view along line P-P in FIG. 54.
Figure 56:
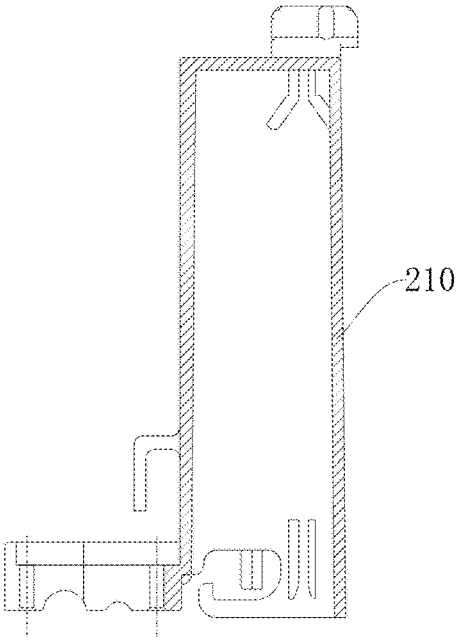
FIG. 56 is a sectional view along line Q-Q in FIG. 54.

Additionally, as shown in FIG. 52, according to an embodiment of the present invention, the electric control box body 210 is provided with a plurality of wire-running hooks 213. Since components in the electric control box body 210 need to be connected via a wire 251, the electric control box body 210 is provided with multiple wires 251. Thus, the wires 251 are arranged in the wire-running hooks 213, and then winded around a circumference of the electric control box body 210, such that the various wires 251 in the electric control box body 210 are arranged in good order, along with simplicity, safety and reliability.

Figure 49:
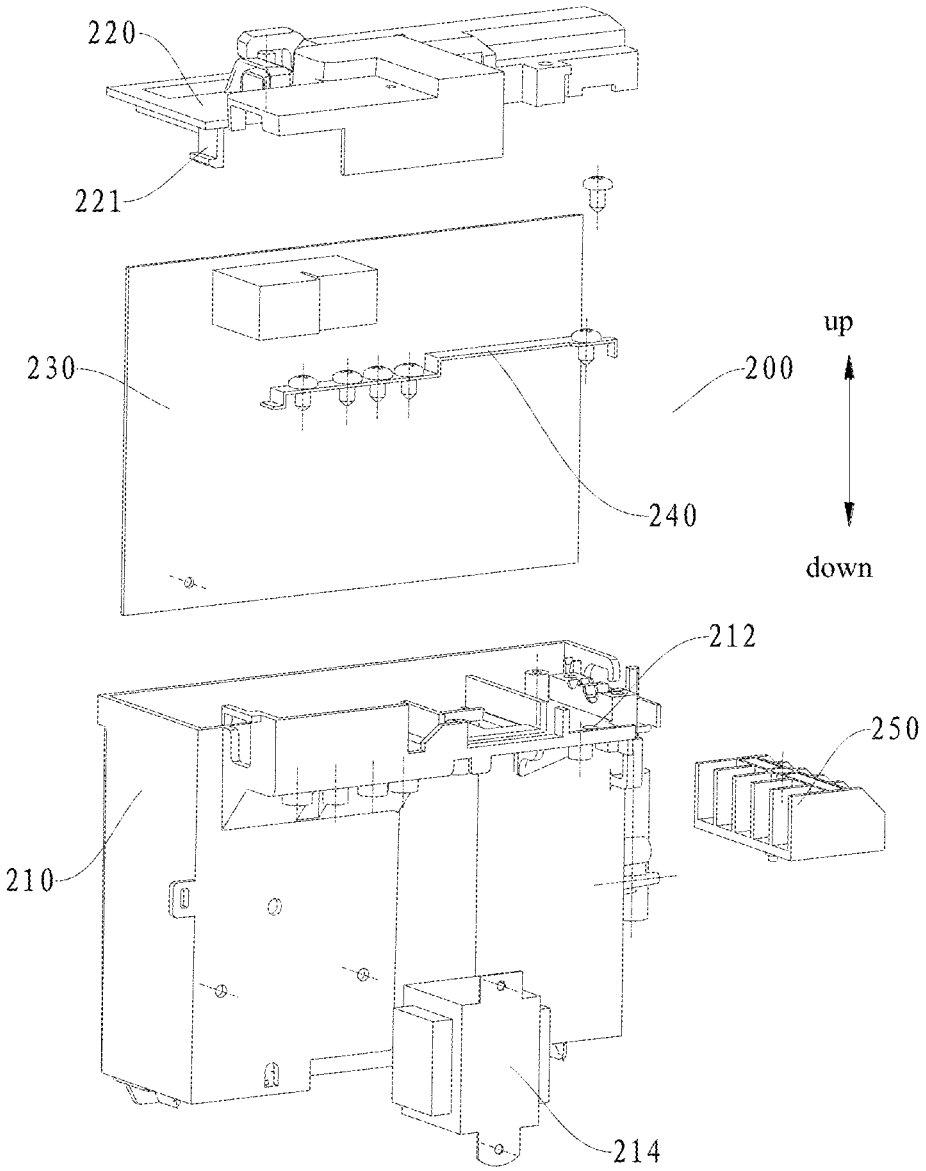
FIG. 49 is an exploded view of an electric control box assembly according to another embodiment of the present invention.

As shown in FIG. 49, according to an embodiment of the present invention, at least one fastener 214 is provided at a bottom of the electric control box body 210. By providing the fastener 214 at the bottom of the electric control box body 210, it is convenient to fix and mount the electric control box assembly 200 to the indoor unit 1000, so as to make the structure of the indoor unit 1000 stable and guarantee the normal operation of the system.

According to an embodiment of the present invention, the electric control box lid 220 is connected to the top of the electric control box body 210 via a snap 221. Specifically, a plurality of snaps 221 are provided at a front side of the electric control box lid 220, while the top of the electric control box body 210 is provided with a plurality of fixing bosses connected with the snaps 221 of the electric control box lid 220 in a snapping manner. The plurality of snaps 221 are in one-to-one correspondence with the fixing bosses. Then, a rear side of the electric control box lid 220 is fixed with a rear side of the electric control box body 210 via a screw. In such a way, the electric control box lid 220 is connected to the top of the electric control box body 210 via the snap 221, which reduces the assembling of redundant connectors and considerably lowers the mounting cost. Moreover, the connection via the snap 221 decreases the assembling and disassembling procedures of the electric control box assembly 200 and improves the assembling efficiency of the electric control box assembly 200.

Figure 57:
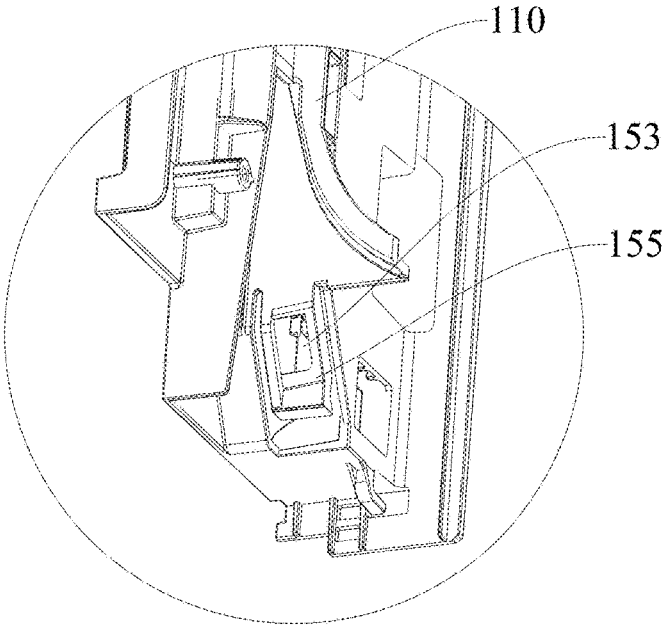
FIG. 57 is a partially enlarged view of an upper base plate according to an embodiment of the present invention.
Figure 58:
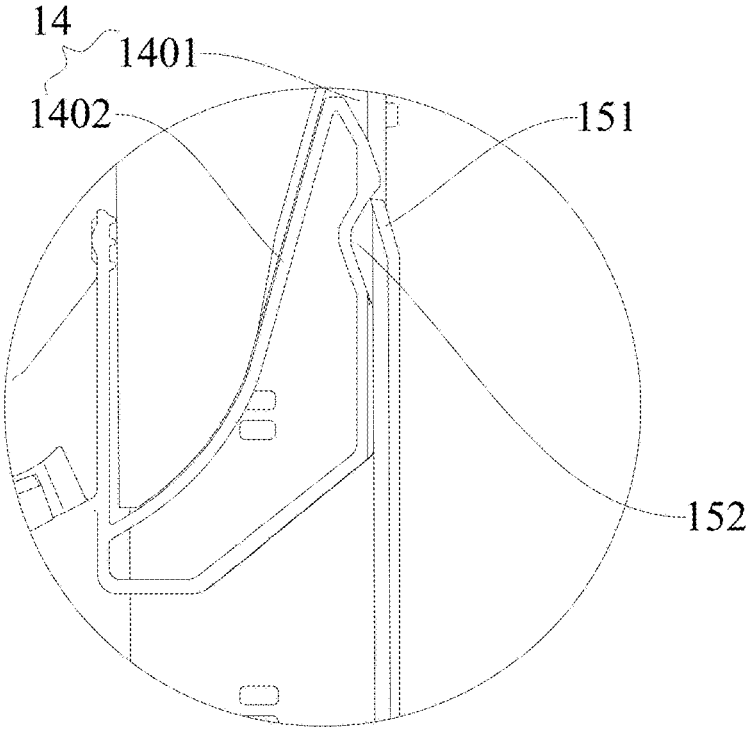
FIG. 58 is a schematic view showing a connected structure of an upper base plate and a lower base plate according to an embodiment of the present invention.

In some embodiments, as shown in FIGS. 57 and 58, the indoor unit 1000 further includes a guide assembly 14 for guiding the lower base plate 120 in the process of mounting and dismounting the lower base plate 120. The guide assembly 14 includes a guide groove 1401 and a guide rail 1402. The guide groove 1401 is provided in the upper base plate 110, and the guide rail 1402 is fitted with the guide groove 1401 and disposed on the lower base plate 120. In such a way, when the upper base plate 110 is being assembled with the lower base plate 120, the guide rail 1401 of the lower base plate 120 may be inserted into the guide groove 1401 of the upper base plate 110 therealong, so as to facilitate the positioning and mounting of the upper base plate 110 and the lower base plate 120. Moreover, the fit of the guide rail 1402 and the guide groove 1401 may improve the connection strength between the upper base plate 110 and the lower base plate 120.

Preferably, the guide rail 1402 is provided at each of left and right end faces of the lower base plate 120, and the guide groove 1401 of the upper base plate 110 is provided in a corresponding manner.

Specifically, as shown in FIG. 58, the guide groove 1401 is provided with a position limiting protrusion 151, the guide rail 1402 is provided with a position limiting groove 152, and the position limiting protrusion 151 is fitted in the position limiting groove 152. In such a way, in the process of inserting the guide rail 1402 into the guide groove 1401, when the position limiting protrusion 151 is snapped into the position limiting groove 152, it is further convenient to position the lower base plate 120 and the upper base plate 110.

Further, as shown in FIG. 57, the upper base plate 110 is provided with a connecting groove 153, the lower base plate 120 is provided with a connecting protrusion (not shown in Figures), and the connecting protrusion is fitted in the connecting groove 153, so as to further position the lower base plate 120.

In a specific example of the present invention, the connecting protrusion is provided at a left end face or a right end face of the lower base plate 120. As shown in FIG. 58, an elastic arm 155 is provided at a corresponding end of the upper base plate 110, and the connecting groove 153 is provided in the elastic arm 155. When the lower base plate 120 is mounted upwards to the upper base plate 110, the end face of the lower base plate 120 or the connecting protrusion touches and jacks up the elastic arm 155, and thus the elastic arm 155 is deformed in a direction running away from the lower base plate 120. When the lower base plate 120 is assembled in place, the connecting protrusion is snapped into the connecting groove 153, and the elastic arm 155 is restored, so as to fix the lower base plate 120 to the upper base plate 110.

Further, the lower base plate 120 is mounted to the upper base plate 110 via a third threaded fastener. That is, the lower base plate 120 is also connected to the upper base plate 110 via the fastener (like the screw), besides the above snap structure, which guarantees the firmness of connecting the upper base plate 110 with the lower base plate 120 and improves the safety of using the indoor unit 1000.

The other configurations and operations of the indoor unit 1000 according to embodiments of the present invention are known to those skilled in the art, which will not be elaborated herein.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation or position as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "specific examples" or "some examples" means that a particular feature, structure, material, or characteristic described in connection with the embodiment or example is included in at least one embodiment or example of the present invention. Thus, the appearances of the above phrases throughout this specification are not necessarily referring to the same embodiment or example of the present invention. Furthermore, the particular features, structures, materials, or characteristics may be combined in any suitable manner in one or more embodiments or examples. Those skilled in the art can integrate and combine different embodiments or examples and the features in different embodiments or examples in the specification.

Although embodiments of the present invention have been shown and illustrated, it shall be understood by those skilled in the art that various changes, modifications, alternatives and variants without departing from the principle and spirit of the present invention are acceptable. The scope of the present invention is defined by the claims or the like.

What is claimed is:

1. An indoor unit for an air conditioner, comprising:

a housing comprising an upper base plate provided with an air inlet, a lower base plate detachably mounted to the upper base plate and provided with an air outlet, and a front cover detachably mounted to the upper base plate;

a fan detachably mounted to the lower base plate; and a heat exchanger detachably mounted to the upper base plate and having a supporting seat and a heat exchanger core body mounted to the supporting seat, wherein the upper base plate is provided with a first positioning portion, the supporting seat is provided with a second positioning portion, and the first positioning portion is configured to be fitted with the second positioning portion to position the heat exchanger core body to the upper base plate, wherein a plurality of bent pipe structures are provided at an end of the heat exchanger core body, one end of the heat exchanger core body is mounted to the supporting seat, the supporting seat is provided with a plurality of mounting holes corresponding to the plurality of bent pipe structures, at least one of the plurality of mounting holes is a positioning mounting hole, an elastic cantilever is provided in the positioning mounting hole, and is configured to avoid the bent pipe structure when mounting the heat exchanger core body and configured to be restored to position a corresponding bent pipe structure after the heat exchanger core body is mounted in place.

2. The indoor unit according to claim 1, wherein the first positioning portion is configured as a hanging groove, and the second positioning portion is configured as a hanging element.

3. The indoor unit according to claim 2, wherein the hanging element protrudes beyond an outer edge of the supporting seat and obliquely extends upwards along a direction from front to rear, the hanging element has a supporting plane at a bottom thereof, and the supporting plane is supported on a bottom wall of the hanging groove.

4. The indoor unit according to claim 3, wherein an upper portion of the hanging element has an inclined surface, a top portion of the hanging groove is provided with a fitting surface, and the inclined surface and the fitting surface abut against each other to position the hanging element in the hanging groove.

5. The indoor unit according to claim 1, wherein part of a side wall of the positioning mounting hole is configured as the elastic cantilever, and a free end of the elastic cantilever is provided with a protrusion protruding towards a center of the positioning mounting hole.

6. The indoor unit according to claim 5, wherein a gap is formed between the free end of the elastic cantilever and rest of the side wall of the positioning mounting hole.

7. The indoor unit according to claim 1, wherein the upper base plate comprises:

a rear baffle, to which the heat exchanger is mounted;

an upper cover plate having a rear edge connected with an upper edge of the rear baffle and provided with the air inlet;

a left end plate having a rear edge connected with a left edge of the rear baffle and an upper edge connected with a left edge of the upper cover plate; and a right end plate having a rear edge connected with a right edge of the rear baffle and an upper edge connected with a right edge of the upper cover plate, wherein the lower base plate is detachably mounted at a right side of the left end plate and at a left side of the right end plate, the left end plate is located at a left side of the lower base plate and the right end plate is located at a right side thereof.

8. The indoor unit according to claim 7, wherein the upper base plate further comprises:

a left shield plate mounted to a left side of the left end plate; and a right shield plate mounted to a right side of the right end plate, wherein the front cover is detachably mounted over the left shield plate and the right shield plate.

9. The indoor unit according to claim 7, wherein an air inlet grille is provided at the air inlet of the upper cover plate.

10. An indoor unit for an air conditioner, comprising:

a housing comprising an upper base plate provided with an air inlet, a lower base plate detachably mounted to the upper base plate and provided with an air outlet, and a front cover detachably mounted to the upper base plate;

a fan detachably mounted to the lower base plate; and a heat exchanger detachably mounted to the upper base plate and having a supporting seat and a heat exchanger core body mounted to the supporting seat, wherein the upper base plate is provided with a first positioning portion, the supporting seat is provided with a second positioning portion, and the first positioning portion is configured to be fitted with the second positioning portion to position the heat exchanger core body to the upper base plate, wherein the front cover defines a covering chamber, the upper base plate and the lower base plate are disposed in the covering chamber and covered by the front cover, and an air supply port corresponding to the air outlet is provided in the front cover.

11. The indoor unit according to claim 10, wherein the front cover comprises:

a front panel covering front surfaces of the upper base plate and the lower base plate;

a lower panel having a front edge connected with a lower edge of the front panel, and covering a lower surface of the lower base plate, wherein the air supply port is provided at a position where the front panel and the lower panel are connected;

a left panel having a front edge connected with a left edge of the front panel and a lower edge connected with a left edge of the lower panel, and rotatably mounted to a left side of the upper base plate and covering the left side thereof; and a right panel having a front edge connected with a right edge of the front panel and a lower edge connected with a right edge of the lower panel, and rotatably mounted at a right side of the upper base plate and covering the right side thereof.

12. The indoor unit according to claim 10, wherein the fan comprises:

a fan wheel detachably mounted to the lower base plate; and a motor detachably mounted to the lower base plate and connected with the fan wheel in a transmission way.

13. The indoor unit according to claim 12, wherein a motor mounting groove is provided in the lower base plate, the upper base plate is provided with a water receiving cover, the motor is mounted in the motor mounting groove, the water receiving cover is located below the heat exchanger and presses the motor in the motor mounting groove.

14. The indoor unit according to claim 10, wherein the lower base plate and the upper base plate define a piping-running through hole; and the indoor unit further comprises a pipe-running cover plate detachably mounted to the upper base plate and the lower base plate and covering the piping-running through hole.

15. The indoor unit according to claim 14, wherein the pipe-running cover plate comprises:

a vertical plate detachably mounted to the upper base plate; and a horizontal plate connected with the vertical plate and detachably mounted to the lower base plate.

16. The indoor unit according to claim 15, wherein a side snap hook is provided at an upper edge of the vertical plate and extends outwards, a side snap groove is provided in a side wall of the upper base plate, and the side snap hook is snap-fitted in the side snap groove.

17. The indoor unit according to claim 15, wherein a rear snap hook is provided at the upper edge of the vertical plate and extends rearwards, a rear snap groove is provided in a rear wall of the upper base plate, and the rear snap hook is snap-fitted in the rear snap groove.

18. The indoor unit according to claim 15, wherein an upper arc positioning groove is provided in an inner surface of the upper edge of the vertical plate, the upper base plate is provided with an upper arc positioning rib, and the upper arc positioning rib is fitted in the upper arc positioning groove.

19. The indoor unit according to claim 15, wherein a lower snap hook is provided at a side edge of the horizontal plate away from the vertical plate and extends downwards, a lower snap groove is provided in a bottom wall of the lower base plate, and the lower snap hook is snap-fitted in the lower snap groove.

20. The indoor unit according to claim 19, wherein a guiding groove is provided at a side edge of the bottom wall of the lower base plate facing towards the horizontal plate, the lower snap hook is slidably fitted in the guiding groove, and a part of the bottom wall of the lower base plate is clamped between the lower snap hook and the horizontal plate.

21. The indoor unit according to claim 20, wherein a lower-snap-hook guiding surface is provided at an end face of the lower snap hook away from the horizontal plate, and a snap-hook guiding surface is provided in an inner wall of the guiding groove facing towards the horizontal plate and configured to be fitted with the lower-snap-hook guiding surface.

22. The indoor unit according to claim 10, wherein the supporting seat is provided at a left end of the heat exchanger core body and configured as a left supporting seat, a right connecting plate is provided at a right end of the heat exchanger core body, the left supporting seat is provided with a left hanging element, a left hanging groove is provided in the upper base plate, and the left hanging element is fitted in the left hanging groove to hang the left supporting seat to the upper base plate; and the indoor unit further comprises a water receiving cover disposed to the right connecting plate and provided with a right hanging element, a right hanging groove is provided in the upper base plate, and the right hanging element is fitted in the right hanging groove to hang the water receiving cover to the upper base plate.

23. The indoor unit according to claim 22, wherein the left hanging element protrudes beyond an outer edge of the left supporting seat and obliquely extends upwards along a direction from front to rear, and the right hanging element protrudes beyond an outer edge of the water receiving cover and obliquely extends upwards along the direction from front to rear.

24. The indoor unit according to claim 23, wherein a bottom of the left hanging element has a left supporting plane and the left supporting plane is supported on a bottom wall of the left hanging groove, and a bottom of the right hanging element has a right supporting plane and the right supporting plane is supported on a bottom wall of the right hanging groove.

25. The indoor unit according to claim 24, wherein an upper portion of the left hanging element has a left inclined surface, a top portion of the left hanging groove is provided with a left fitting surface, and the left inclined surface and the left fitting surface abut against each other to position the left hanging element in the left hanging groove; and an upper portion of the right hanging element has a right inclined surface, a top portion of the right hanging groove is provided with a right fitting surface, and the right inclined surface and the right fitting surface abut against each other to position the right hanging element in the right hanging groove.

26. The indoor unit according to claim 25, wherein a front end of the left fitting surface has a left guiding surface, and an included angle between the left guiding surface and a vertical direction is larger than an included angle between the left fitting surface and the vertical direction; and a front end of the right fitting surface has a right guiding surface, and an included angle between the right guiding surface and the vertical direction is larger than an included angle between the right fitting surface and the vertical direction.

27. The indoor unit according to claim 25, wherein an upper end of a rear wall of the left supporting seat is higher than a lower end of the left hanging element, such that a top wall of the left hanging groove abuts against the rear wall of the left supporting seat; and an upper end of a rear wall of the water receiving cover is higher than a lower end of the right hanging element, such that a top wall of the right hanging groove abuts against the rear wall of the water receiving cover.

28. The indoor unit according to claim 10, wherein the heat exchanger is provided with an input-output pipe; and the indoor unit further comprises a pipe-routing press strip mounted to an inner surface of the housing and pressing the input-output pipe against the inner surface of the housing.

29. The indoor unit according to claim 28, wherein an inserting column and a snap hook are provided at two ends of the pipe-routing press strip respectively, the housing is provided with an inserting groove and a snap step, the inserting column is inserted in the inserting groove while the snap hook is hung to the snap step.

30. The indoor unit according to claim 28, wherein a snap strip and a mounting plate are provided at two ends of the pipe-routing press strip respectively, the housing is provided with a clamping portion, the snap strip is connected with the clamping portion in a clamping manner, and the mounting plate is mounted to the housing via a first threaded fastener.

31. The indoor unit according to claim 28, further comprising a water receiving cover mounted in the housing and located between the heat exchanger and the fan.

32. The indoor unit according to claim 31, wherein a pipe-through port is provided in the water receiving cover, and the input-output pipe passes through the pipe-through port.

33. The indoor unit according to claim 31, wherein a water-receiving-cover position limiting protrusion is provided on the water receiving cover, and the heat exchanger is stopped by the water-receiving-cover position limiting protrusion.

34. An indoor unit for an air conditioner, comprising:

a housing comprising an upper base plate provided with an air inlet, a lower base plate detachably mounted to the upper base plate and provided with an air outlet, and a front cover detachably mounted to the upper base plate;

a fan detachably mounted to the lower base plate; and a heat exchanger detachably mounted to the upper base plate and having a supporting seat and a heat exchanger core body mounted to the supporting seat, wherein the upper base plate is provided with a first positioning portion, the supporting seat is provided with a second positioning portion, and the first positioning portion is configured to be fitted with the second positioning portion to position the heat exchanger core body to the upper base plate, wherein the indoor unit further comprises a guide assembly for guiding the lower base plate when mounting and dismounting the lower base plate, wherein the guide assembly comprises:

a guide groove provided in the upper base plate; and a guide rail fitted with the guide groove and disposed on the lower base plate.

35. The indoor unit according to claim 34, wherein the guide groove is provided with a position limiting protrusion, the guide rail is provided with a position limiting groove, and the position limiting protrusion is fitted in the position limiting groove.

36. The indoor unit according to claim 34, wherein the upper base plate is provided with a connecting groove, the lower base plate is provided with a connecting protrusion, and the connecting protrusion is fitted in the connecting groove.

* * * * *